US006243118B1

(12) United States Patent
Akichika et al.

(10) Patent No.: US 6,243,118 B1
(45) Date of Patent: Jun. 5, 2001

(54) ELECTROSTATIC RECORDING APPARATUS FOR SUPPLYING VAPORIZED SOLVENT AND LIQUID TONER TO AN ELECTROSTATIC LATENT IMAGE

(75) Inventors: Yoshinori Akichika; Toshiaki Ohira, both of Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/297,580

(22) PCT Filed: Nov. 28, 1997

(86) PCT No.: PCT/JP97/04351

§ 371 Date: May 7, 1999

§ 102(e) Date: May 7, 1999

(87) PCT Pub. No.: WO98/25187

PCT Pub. Date: Nov. 6, 1998

(30) Foreign Application Priority Data

Dec. 5, 1996 (JP) ..... 8-325742
Dec. 5, 1996 (JP) ..... 8-325743
Dec. 5, 1996 (JP) ..... 8-325744

(51) Int. Cl.[7] ..... G03G 15/00; G03G 15/10
(52) U.S. Cl. ..... 347/155; 399/237
(58) Field of Search ..... 347/112, 140, 347/155, 158, 149, 141; 399/127, 130, 237, 238

(56) References Cited

U.S. PATENT DOCUMENTS 4,001,838 * 1/1977 Maddox ..... 347/155

FOREIGN PATENT DOCUMENTS 51-46710 of 1976 (JP) .
52-46818 of 1977 (JP) .
58-20028 of 1983 (JP) .
62-144184 of 1987 (JP) .
1-117650 of 1989 (JP) .
3-28434 of 1991 (JP) .
7-44025 of 1995 (JP) .

* cited by examiner

*Primary Examiner*—Joan Pendegrass
(74) *Attorney, Agent, or Firm*—Pollock, Vande Sande & Amernick, RLLP

(57) ABSTRACT

In an electrostatic recording apparatus, a recording medium is transported to a vaporized solvent supply unit where a vaporized organic solvent is given to the recording surface of the recording medium. Then, the recording medium is transported to an electrostatic recording head where an electrostatic latent image is formed on the recording medium. Next, the recording medium is transported to a development processing unit where the development process of the electrostatic latent image using a liquid toner is performed.

10 Claims, 16 Drawing Sheets

CHANGE IN DROPOUT DUE TO CONTINUOUS OUTPUT

| OUTPUT DISTANCE (m) | ISOPAR VAPOR IS PRESENT (THIS INVENTION) | PRIOR ART |
|---|---|---|
| 0.5 | 4.5 | 4.5 |
| 1 | 4.5 | 4.5 |
| 1.5 | 4.5 | 3.5 |
| 2 | 4.5 | 3 |
| 2.5 | 4.5 | 3 |
| 3 | 4.5 | 3 |
| 3.5 | 4.5 | 2.5 |
| 4 | 4.5 | 2.5 |
| 4.5 | 4 | 2 |
| 5 | 4.5 | 2 |

(OUTPUT CONDITIONS)
- PAPER FEED RATE : 0.5ips
- TEMPERATURE : 22°C
- HUMIDITY : 54%
- RESOLUTION : 400dpi

- DROPOUT EVALUATION DATA OF 0.5m LONG WAS CONTINUOUSLY OUTPUT FOR 10 SHEETS.
- THE DROPOUT LEVELS RANGE FROM 1 TO 5; 5 IS THE BEST.

ELECTROSTATIC RECORDING APPARATUS FOR SUPPLYING VAPORIZED SOLVENT AND LIQUID TONER TO AN ELECTROSTATIC LATENT IMAGE

TECHNICAL FIELD

The present invention relates to an electrostatic recording apparatus for forming an electrostatic latent image on a recording media and then developing it using a liquid toner, and an image density control method thereof.

BACKGROUND ART

An electrostatic recording apparatus obtains an image by forming an electrostatic latent image on a recording medium at an electrostatic recording head and then developing the electrostatic latent image by use of a liquid toner at a development processing unit. The recording medium is a special paper having functions of creating discharge in cooperation with the electrostatic recording head to accumulate the generated static electricity, and is an opaque paper, a tracing paper, a clear film, a synthetic paper and so forth. The recording medium may typically be manufactured by applying the conductive processing to a substrate paper used as the base and then coating it with a nonconductive dielectric layer. The mechanism of one typical electrostatic recording apparatus will be explained with reference to FIG. 1 below.

FIG. 1 is a diagram showing an electrostatic recording head and development processing unit of an electrostatic recording apparatus. A recording medium 1 wound into a roll-like shape is transported in a direction of arrow "A" in the drawing, so that it is transported to an electrostatic recording head 2 and a development processing unit 3. The electrostatic recording head 2 consists essentially of needle-like main electrodes (to be referred to as "nibs" hereinafter) laid out at the density equivalent to the resolution, and auxiliary electrodes provided in close proximity with the nibs (the nibs and the auxiliary electrodes are not shown in the drawing). At the electrostatic recording head 2, a voltage of several hundreds of volt is applied to the nibs in units of pixels of image data to cause discharge between the nibs and the recording medium 1, so that the recording medium 1 is charged. Whereby, an electrostatic latent image corresponding to the image data is formed on the recording medium 1. The recording medium 1 passing through the electrostatic recording head 2 is coated with a liquid toner 32 by a toner roller 31 of the development processing unit 3. The liquid toner 32 contains toner particles which are dissolved in a solvent called the "Isopar". The toner particles include the pigment for color generation and the adhesive for fixation on the surface of the recording medium 1. The toner particles are charged to have the opposite polarity to that of the electrostatic latent image formed on the recording medium 1. Accordingly, the toner particles coated on the recording medium 1 by the toner roller 31 are attracted by the electrostatic force toward the electrostatic latent image to be fixed on the surface layer of the recording medium 1. Whereby, the electrostatic latent image is developed.

The development-completed recording medium 1 is transported to a toner aspiration unit 34 of the development processing unit 3, and any extra liquid toner 32 residing on the surface of the recording medium 1 is removed through suction by the toner aspiration unit 34. The sucked liquid toner 32 is collected, and then is reused at later development process steps. Thereafter, the recording medium 1 is transported to a drier device 4 where any solvent residing on the surface of the recording medium 1 is dried to be removed.

As shown in FIG. 2, the toner aspiration unit 34 includes a vacuum channel 51, a vacuum hose 52 and a vacuum pump 53. The aspiration or suction of the liquid toner 32 is performed by giving a negative pressure to a groove portion 54 of the vacuum channel 51 via the vacuum hose 52 using the vacuum pump 53. The groove portion 54 of the vacuum channel 51 is formed so that its width is narrower than the recording width of the recording medium 1. Whereby, the groove portion 54 is sealed by the recording medium 1 to obtain the negative pressure. Additionally, one end of the vacuum hose 52 is coupled to a through hole in the bottom of the vacuum channel 51.

Next, a color electrostatic recording apparatus of the single-path scheme will be explained with reference to FIG. 4. While in the electrostatic recording apparatus shown in FIG. 1 only one pair of electrostatic recording head 2 and development processing unit 3 is provided, in the color electrostatic recording apparatus of the single-path scheme, four pairs of electrostatic recording heads and development processing units are provided in order to form a color image by overlapping four different colors of black, cyan, magenta and yellow, typically. Note here that an electrostatic recording head 2*a*, toner roller 31*a* and toner aspiration unit 34*a* for black; an electrostatic recording head 2*b*, toner roller 31*b* and toner aspiration unit 34*b* for cyan; an electrostatic recording head 2*c*, toner roller 31*c* and toner aspiration unit 34*c* for magenta; and an electrostatic recording head 2*d*, toner roller 31*d* and toner aspiration unit 34*d* for yellow are shown in FIG. 4. In the color electrostatic recording apparatus of the single-path scheme, the color image is obtained by overlapping of such four colors during one-time transportation of the recording medium 1.

(First Problem)

In the electrostatic recording apparatus shown in FIG. 1, the specific phenomenon called "drop out" can take place. More specifically, in spite of the fact that the image data of the pixels to be recorded is input to the electrostatic recording head 2, any accurate electrostatic latent image is not formed on the recording medium 1 resulting in lack of part of an image corresponding to such pixels. One possible cause of the creation of the "drop out" is the contamination of the electrostatic recording head 2. More precisely, silica particles of about several micrometers in diameter, called "spacers", are dispersed at the appropriate density on the surface of the recording medium 1. These spacers are for defining a space gap corresponding in thickness to the size of such particles between the recording medium 1 and the electrostatic recording head 2 to thereby maintain a discharge gap required. When some spacers are peeled off from the recording medium 1 to attach to the electrostatic recording head 2, an excessively widened discharge gap is generated. In addition, if the spacers drop down from the recording medium 1 onto the associative electrodes (the nibs and the auxiliary electrodes), then the resultant discharge is disturbed to decrease in effect. The "drop out" can also be different in the generation frequency depending upon the different in-use environments. Typically, the "drop out" generation frequency is less when the humidity is at low level rather than when at high level. It has been considered by those skilled in the art that this is because the higher the humidity, the more the creatability of discharge between the recording medium 1 and the electrostatic recording head 2. Similar "drop-out" problems can occur in the color electrostatic recording apparatus shown in FIG. 3 also.

As discussed above, while the conventional electrostatic recording apparatus is faced with a problem as to unavailability of any desired images due to the "drop out", one approach to avoiding the problem is merely to make the electrostatic recording head clean. However, the cleanup of the electrostatic recording head should require that the electrostatic recording apparatus is interrupted in operation to permit a user to manually open its cover. In the case of continuously performing a great number of printout tasks by use of an elongate recording medium wound into a roll-like shape, a user or worker is required to clean the electrostatic recording head by rendering the electrostatic recording apparatus inoperative from time to time, which would result in an increase in workload. In addition, as the "drop out" generation frequency per se can vary with a change in humidity of the in-use environments of the electrostatic recording apparatus, it is required that the cleanup procedure be carried out at irregular time intervals determinable depending on such ambient humidity change. Furthermore, since the color electrostatic recording apparatus shown in FIG. 4 is designed so that several different colors are overlapped on one another for production of a color image, a liquid toner of one color at an upper process step can badly behave to adhere to an electrostatic recording head for printing another color at a lower process step, resulting in a serious bar to successful achievement of discharge at this electrostatic recording head.

(Second Problem)

Due to the fact that the electrostatic recording apparatus is designed to form an electrostatic latent image by causing discharge between an electrostatic recording head and a recording medium, it is required in order to obtain a desired image that discharge be effected in units of pixels thus charging the recording medium. Incidentally, a typical liquid toner usable in the electrostatic recording apparatus of the type stated above may be a diluted liquid (also known as a "mixed toner") comprising a mixture of a concentrated liquid (also known as "conc-toner"), which consists of 20% of solid components and 80% of solvent, and a solvent at a fixed concentration, for example. This diluted liquid is made of 3% of solid components And 97% of solvent, for example. The supplement of the concentrated liquid required for constantly retaining the concentration of the diluted liquid is done by a concentrated liquid pump for supplying the concentrated liquid based on the optical reflection factor or "reflectivity" of image dot data printed using a liquid toner on a recording medium. However, as the mixed toner that is the diluted liquid is partly collected for the reuse and returned to a diluted liquid tank, the long-term use can result in a gradual increase in amount of dust and/or toner particles of other colors, which in turn leads to the deterioration in image quality. With the above-noted method of controlling only the concentrated liquid supplement based on the optical reflectivity of image data, this method is incapable of avoiding such mixed toner's deterioration, which results in the decrease in the quality of the printed images. One example is that if dust such as paper becomes much contained in the liquid toner, then the resulting image density will no longer increase irrespective of how much concentrated liquid is additionally fed thereto while simultaneously letting printed images stay low in quality. Another example is that if a diluted liquid of bright color is mixed with those solid components of other different colors, then the optical reflectance hardly increases.

(Third Problem)

The toner aspiration unit 34 shown in FIG. 2 suffers from a following problem. The recording medium 1 can be damaged during the transportation or upon the loading to the electrostatic recording apparatus. The damage may generally be considered to occur when the recording medium 1 has a cutaway portion or dead fold at its edges. In this case, an unwanted gap can be generated between the recording medium 1 and the groove portion 54 of the vacuum channel 51, the former air-tightly covering the latter. This results in the air entering or "invading" from such gap destroying the vacuum environment so that the intended negative pressure is no longer attainable. As a result, the toner aspiration along the full width of the recording medium cannot be obtained at those edge portions whereat the recording medium 1 is partly cut or folded. For this reason, as shown in FIG. 3, the liquid toner 32 continues residing on the surface of the recording medium 1 at such portions, which in turn makes it impossible or at least greatly difficult to obtain a desired image. Even when the electrostatic recording head 2 is modified so that its width is slightly narrower than the width of the recording medium 1 to eliminate the attachment of the residual liquid toner 32 to the electrostatic recording head 2, the corners of the electrostatic recording head 2 attempt to create the fold lines on the recording medium 1, which makes it impossible for the vacuum channel 51 to offer the suction functionality.

With regard to the color electrostatic recording apparatus shown in FIG. 4, this is designed to first record black part in order to record a marking for position alignment, called "tick mark", and then measure a superposition timing by detection of this tick mark for sequential recording of three colors of cyan, magenta and yellow. Note that as the tick mark will finally be cut away, only image is left on the recording medium 1.

To record the tick mark at the edge of the recording medium 1, it is required that the toner roller 31*a* for black is coated with the liquid toner in an extended region covering the full width of the recording medium 1. However, the use of the toner aspiration unit 34 shown in FIG. 2 as such toner aspiration unit 34*a* results in the recording medium 1 not being sucked at its edges due to the fact that the vacuum channel 51 employed is inherently designed to suck a limited area narrower than the width of the recording medium 1. Unless the liquid toner coated by the toner roller 31*a* is not sucked in the vacuum channel 51, the liquid toner can badly behave to adhere to the electrostatic recording head 2*b* of the next color resulting in the contamination of the electrostatic recording head 2*b*. If at this time water resides in the liquid toner 32 adhered to the surface of the recording medium 1, then the liquid toner will permeate toward the central part of the recording medium 1 by the capillary action occurring in a gap between the recording medium 1 and the electrostatic record head 2*b*. If this permeated liquid toner overlaps the tick mark, then the accurate color alignment will no longer be expectable. If the permeated liquid toner reaches the image portions, then the image contamination can take place.

In view of the first problem, the first objective of the present invention is to provide an electrostatic recording apparatus capable of greatly reducing the cleaning work of an electrostatic recording head, and further of suppressing the generation of "drop-out" to thereby lighten the user's cleaning workload.

In view of the second problem, the second object of the present invention is to provide an electrostatic recording apparatus and image density control method capable of supplying a liquid toner while constantly retaining the quality of a printed image.

In view of the third problem, the third object of the present invention is to provide an electrostatic recording apparatus capable of sucking a liquid toner by allowing a negative pressure to be sufficiently generated at a vacuum channel even when recording media suffers from physical damages such as cutaway portions and/or fold lines.

In view of the third problem also, the fourth object of the present invention is to provide an electrostatic recording apparatus capable of preventing a liquid toner coated by a toner roller from residing at edges of recording media to contaminate the surfaces of the recording media.

DISCLOSURE OF INVENTION

An electrostatic recording apparatus is disclosed having an electrostatic recording head which forms electrostatic latent images on a recording medium. The electrostatic latent image is developed using a liquid toner. Vaporized solvent is supplied from a solvent supply to the recording medium on an upper process step side of the electrostatic recording head.

In addition, the first electrostatic recording apparatus of the present invention is a single-path electrostatic recording apparatus for forming a color image on a recording medium, which apparatus has a serial combination of a necessary number of recording units for use in forming the color image, each of which units includes an electrostatic recording head for forming an electrostatic latent image on said recording medium, development means for developing said electrostatic latent image using a liquid toner, and vaporized solvent supply means for supplying a vaporized solvent to said recording medium, wherein said vaporized solvent supply means is provided on an upper process step side of said electrostatic recording head, and comprises solvent tray means for storing said solvent, and an absorbing body a part of which is soaked in said solvent stored in said solvent tray means, and said solvent stored in said solvent tray means is absorbed by said absorbing body, and applies said solvent vaporized from a surface of said absorbing body to a recording surface of said recording medium before said recording medium comes into slidable contact with said electrostatic recording head.

A second electrostatic recording apparatus of the present invention is an electrostatic recording apparatus for forming an image on a recording medium by use of a liquid toner containing a solvent and a solid component, which apparatus comprises:

a detector for detecting an optical reflection amount of an image recorded on said recording medium;

a toner vessel for storing said liquid toner;

solvent supply means for supplying said solvent to said toner vessel;

concentrated liquid supply means for supplying a concentrated liquid of high concentration to said toner vessel, said concentrated liquid containing said solvent and said solid component;

first control means for supplying said solvent from said solvent means to said toner vessel when the optical reflection amount detected by said detector is greater than a first value, and for instructing to exchange said toner vessel when the optical reflection amount detected by said detector goes beyond a second value greater than said first value; and second control means for supplying said concentrated liquid from said concentrated liquid supply means to said toner vessel when the optical reflection amount detected by said detector becomes less than a third value, and for instructing to exchange said toner vessel when the optical reflection amount detected by said detector is less than a fourth value smaller than said third value.

An image density control method of the present invention is an image density control method for controlling a density of an image to be formed on a recording medium by using a liquid toner containing a solvent and a solid component, which method comprises the steps of:

detecting an optical reflection amount of the image recorded on said recording medium;

supplying said solvent to said liquid toner when said detected optical reflection amount exceeds a first value;

instructing to exchange said liquid toner when said detected optical reflection amount exceeds a second value greater than said first value;

supplying a concentrated liquid of high concentration to said liquid toner when said detected optical reflection amount is below a third value, said concentrated liquid containing said solvent and said solid component; and instructing to exchange said liquid toner when said detected optical reflection amount is below a fourth value less than said third value.

A third electrostatic recording apparatus of the present invention comprises:

an electrostatic recording head for forming an electrostatic latent image on a recording medium;

development means for developing said electrostatic latent image using a liquid toner; and toner aspiration means for sucking and collecting said liquid toner attached to said recording medium after the development, wherein said toner aspiration means includes:

a first toner aspiration unit for sucking and collecting said liquid toner attached to an image formation region of said recording medium after the development; and a second toner aspiration unit for sucking and collecting said liquid toner attached to opposite ends of said recording medium after the development.

Alternatively, a third electrostatic recording apparatus of the present invention includes:

an electrostatic recording head for forming an electrostatic latent image on a recording medium;

development means for developing said electrostatic latent image by use of a liquid toner; and toner aspiration means for sucking and collecting said liquid toner attached to said recording medium after the development, wherein toner exhaust grooves are respectively formed on surface portions at opposite ends of said recording head in slidable contact with said recording medium.

PREFERRED EMBODIMENTS OF THE PRESENT INVENTION (First Electrostatic Recording Apparatus)

Figure 1:
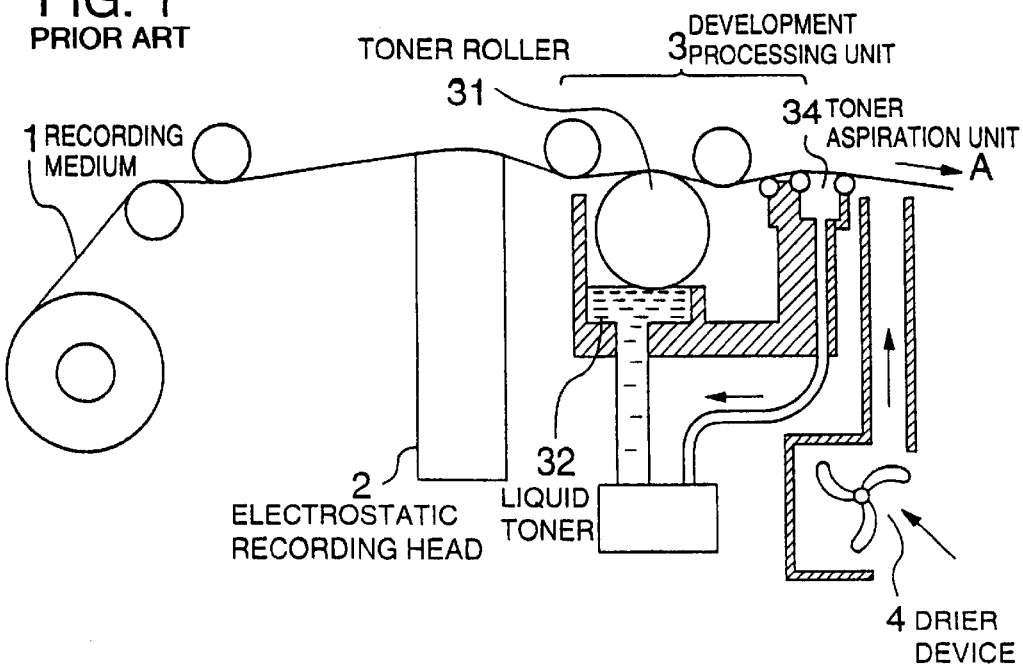
FIG. 1 PRIOR ART
FIG. 1 is a schematic diagram of a conventional electrostatic recording apparatus.
Figure 2:
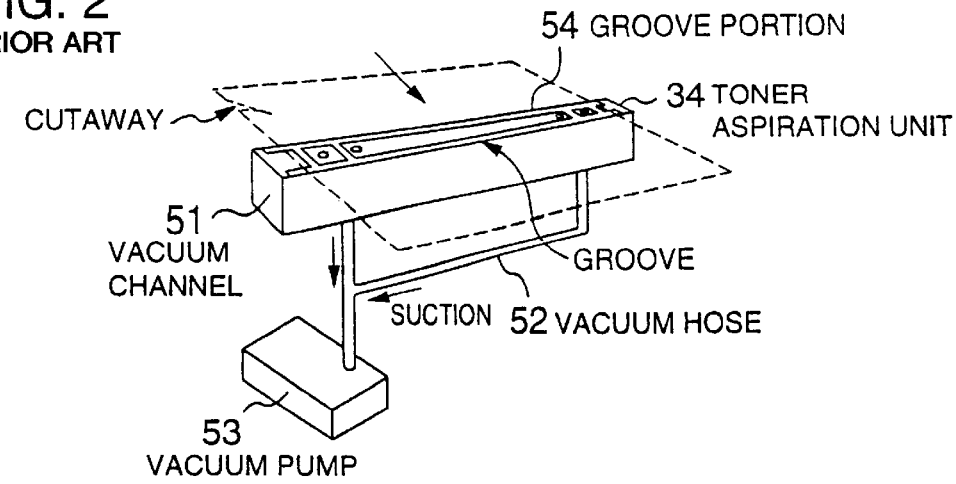
FIG. 2 PRIOR ART
FIG. 2 is a diagram showing a perspective view of a toner aspiration unit shown in FIG. 1.
Figure 3:
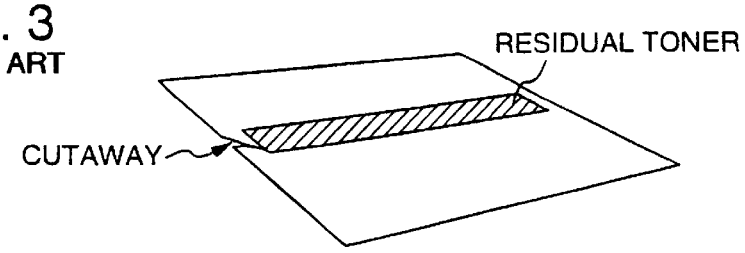
FIG. 3 PRIOR ART
FIG. 3 is a diagram showing a problem in the toner aspiration unit shown in FIG. 2.
Figure 4:
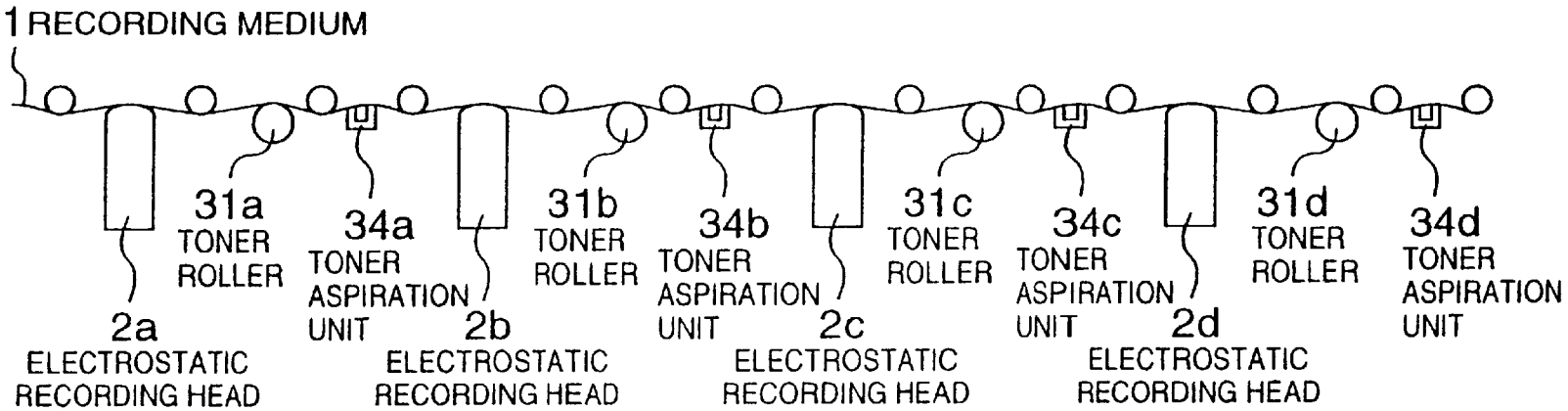
FIG. 4 PRIOR ART
FIG. 4 is a diagram schematically showing a conventional color electrostatic recording apparatus of single path scheme.
Figure 5:
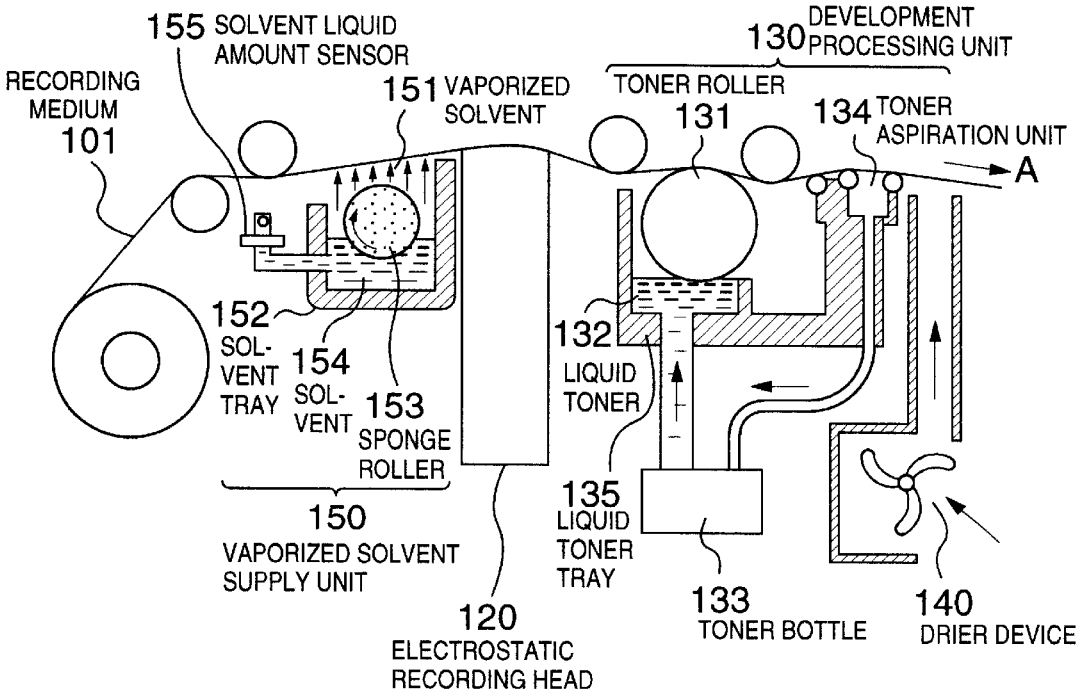
FIG. 5 is a diagram schematically showing an electrostatic recording apparatus in accordance with a first embodiment of a first electrostatic recording apparatus of the present invention.

An electrostatic recording apparatus in accordance with a first embodiment of a first electrostatic recording apparatus of the present invention comprises, as shown in FIG. 5, a recording medium 101 wound into a roll-like shape and transported in a direction of arrow "A" in the drawing; an electrostatic recording head 120 for forming an electrostatic latent image on the recording medium 101; a development processing unit 130 for developing the electrostatic latent image; a drier device 140 for drying the recording medium 101 after development; and a vaporized solvent supply unit 150 provided on the upper process step side of the electrostatic recording head 120 (that is, on the side opposite to the development processing unit 130) for supplying a vaporized solvent 151 to the recording medium 101.

The recording medium 101 has a recording surface on which silica particles or other similar suitable particles, called "spacers", are dispersed at the appropriate density. Each of the spacers has several microns in diameter. The spacers are for providing a gap space between the recording medium 101 and the electrostatic record head 120, which gap is equivalent in thickness to the particle size for retaining a discharge gap between the recording medium 101 and electrostatic recording head 120. The recording medium 101 is cut into pieces where necessary after being recorded a desired image thereon.

At the electrostatic recording head 120, nibs of needle-like or acicular shape are linearly disposed as the main electrodes at intervals of approximately 0.2 mm in a specified direction perpendicular to the transport direction of the recording medium 101 (i.e. along the width of the recording medium 101). Auxiliary electrodes are disposed near the nibs. Upon the occurrence of discharge between the nibs and the auxiliary electrodes in a way corresponding to the input image data, discharge takes place between the recording medium 101 and the electrostatic recording head 120. At this time, as the spacers distributed over the recording medium 101 constitute an appropriate gap space between the recording medium 101 and the electrostatic recording head 120, the discharge easily takes place between the recording medium 101 and the electrostatic recording head 120.

The vaporized solvent supply unit 150 comprises a solvent tray 152 in which a solvent 154 is stored; a sponge roller 153 part of which is soaked into the solvent 154 within the solvent tray 154; and a solvent liquid amount sensor 155 for measuring a residual amount of the solvent 154 within the solvent tray 152. At the vaporized solvent supply unit 150, the vaporized solvent 151 is supplied to the recording surface of the recording medium 101, whereby part near a slidable contact portion between the recording medium 101 and the electrostatic recording head 120 is always filled with a gaseous atmosphere of the vaporized solvent.

Although it is desirable that the solvent 154 is the same in composition as a solvent of a liquid toner 132 described later in order to prevent an unexpected chemical reaction, the solvent should not exclusively be limited thereto in so far as it hardly exhibits the unexpected chemical reaction. Note that the solvent 154 used in experimentation discussed later is "Isopar G" which is commercially available from U.S. Exxon Corp.

The sponge roller 153 is comprised of an adequate absorbable body such as sponge, but any other suitable similar materials including fiber such as cloth or water absorbable or hygroscopic paper or the like may be employable insofar as these may well absorb the solvent 154 for vaporization. The sponge roller 153 is driven by a rotation mechanism (not shown) to rotate. The solvent 154 absorbed by the sponge roller 153 within the solvent tray 152 is vaporized by the rotation of the sponge roller 153 in a space between the recording medium 101 and the sponge roller 153.

The amount of the solvent 154 within the solvent tray 152 is being monitored by the solvent liquid amount sensor 155.

When the solvent 154 decreases in amount to become less than a predefined level, the solvent 154 is supplied from a solvent bottle (not shown) to the solvent tray 152. Whereby, the solvent tray 152 stores therein a constant amount of the solvent 154. In addition, providing a liquid amount sensor to the solvent bottle per se may eliminate the complete absence or depletion of the solvent 154 within the solvent tray 152.

The recording medium 101 passing through the vaporized solvent supply unit 150 is recorded with an electrostatic latent image at the electrostatic recording head 120, and then is transported to the development processing unit 130. The development processing unit 130 comprises a toner roller 131, a toner bottle 133, a toner aspiration unit 134, and a liquid toner tray 135. The liquid toner 132 is supplied from the toner bottle 133 to the liquid toner tray 135 by a pump (not shown) or the like, so that the appropriate amount of the liquid toner 132 is stored in the liquid toner tray 135. The toner roller 131 has its surface in which a spiral groove is formed. The toner roller 131 is supported so that a part of it is soaked into the liquid toner 132 within the liquid toner tray 135. The toner roller 131 is driven to rotate in the counterclockwise direction in the drawing, whereby the liquid toner 132 is coated on the recording surface of the recording medium 101. The liquid toner 132 contains toner particles charged to have the polarity opposite to that of the electrostatic latent image formed on the recording medium 101, which particles are diffused in a chosen organic solvent. When coated on the recording medium 101, the liquid toner 132 is attracted by the electrostatic force of the electrostatic latent image formed on the recording medium 101, and then is attached to the recording medium 101. Whereby, an image corresponding to the input image data is developed.

The recording medium 101 passing through the toner roller 131 is transported to the toner aspiration unit 134. The liquid toner 132 that continues residing on the recording surface without being attracted to the electrostatic latent image during the development is sucked for removal by the toner aspiration unit 134. The liquid toner 132 sucked by the toner aspiration unit 134 is then collected into the toner bottle 133 along a toner recovery or "recycle" route associated therewith. Residual toner particles can be left only at those portions corresponding to the electrostatic latent image on the recording surface of the recording medium 101 which passes through the toner aspiration unit 134. Accordingly, the resultant image may be affirmed.

The recording medium 101 passing through the toner aspiration unit 134 obtains a desired image on its recording surface, but the recording medium 101 is made wet by the solvent. Accordingly, the recording medium 101 is then dried at the drier device 140.

Figure 6:
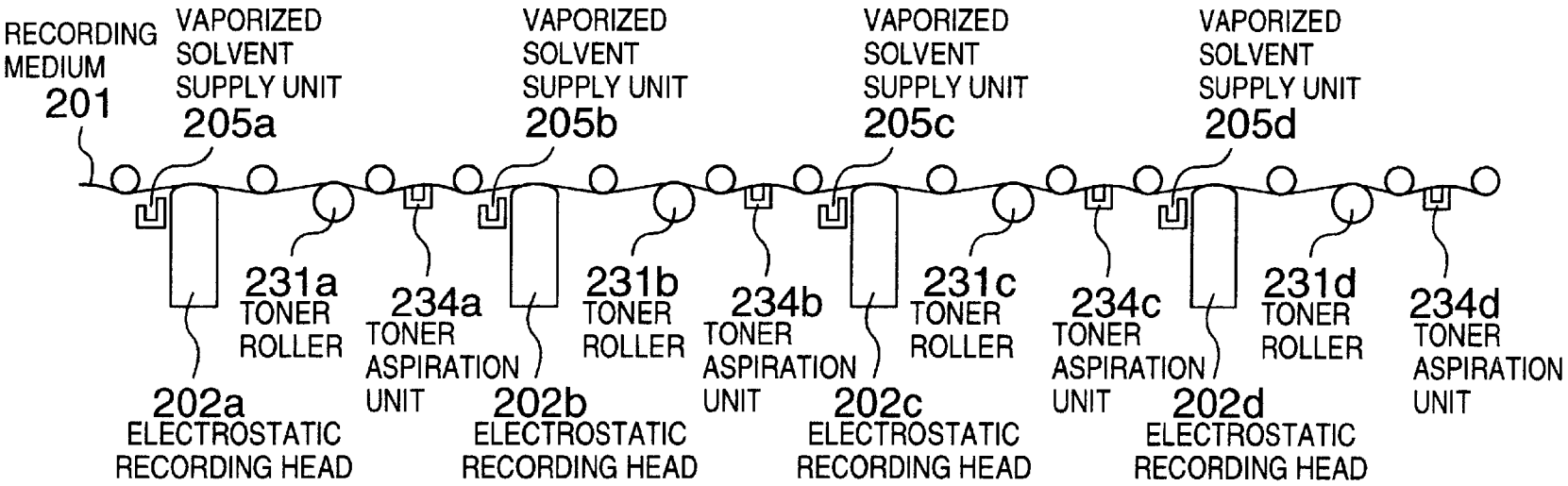
FIG. 6 is a schematic diagram of a color electrostatic recording apparatus in accordance with a second embodiment of the first electrostatic recording apparatus of the present invention.

An explanation will next be given of a color electrostatic recording apparatus using the single path scheme in accordance with a second embodiment of the first electrostatic recording apparatus of the present invention with reference to FIG. 6. This single-path color electrostatic recording apparatus applies the electrostatic recording apparatus shown in FIG. 5 to a single-path color electrostatic recording apparatus.

The single-path color electrostatic recording apparatus is designed to form a color image by overlapping four colors of black, cyan, magenta and yellow; to this end, four sets of vaporized solvent supply units, electrostatic recording heads and development processing units are provided. Note that there are depicted in FIG. 6 a vaporized solvent supply unit 205*a*, electrostatic recording head 202*a*, toner roller 231*a* and toner aspiration unit 234*a* for black; a vaporized solvent supply unit 205*b*, electrostatic recording head 202*b*, toner roller 231*b* and toner aspiration unit 234*b* for cyan; a vaporized solvent supply unit 205*c*, electrostatic recording head 202*c*, toner roller 231*c* and toner aspiration unit 234*c* for magenta; and, a vaporized solvent supply unit 205*d*, electrostatic recording head 202*d*, toner roller 231*d* and toner aspiration unit 234*d* for yellow. With the single-path color electrostatic recording apparatus, a color image is obtained by overlapping the four colors during one-time transportation of a recording medium 201.

In the single-path color electrostatic recording apparatus, since the vaporized solvent supply units 205*a*–205*d* are provided on the upper process step sides of the electrostatic recording heads 202*a*–202*d* respectively, it becomes possible by the vaporized solvent to suppress the "drop out" phenomena occurring when recording of each color, which in turn enables the achievement of a good image.

Figure 7:
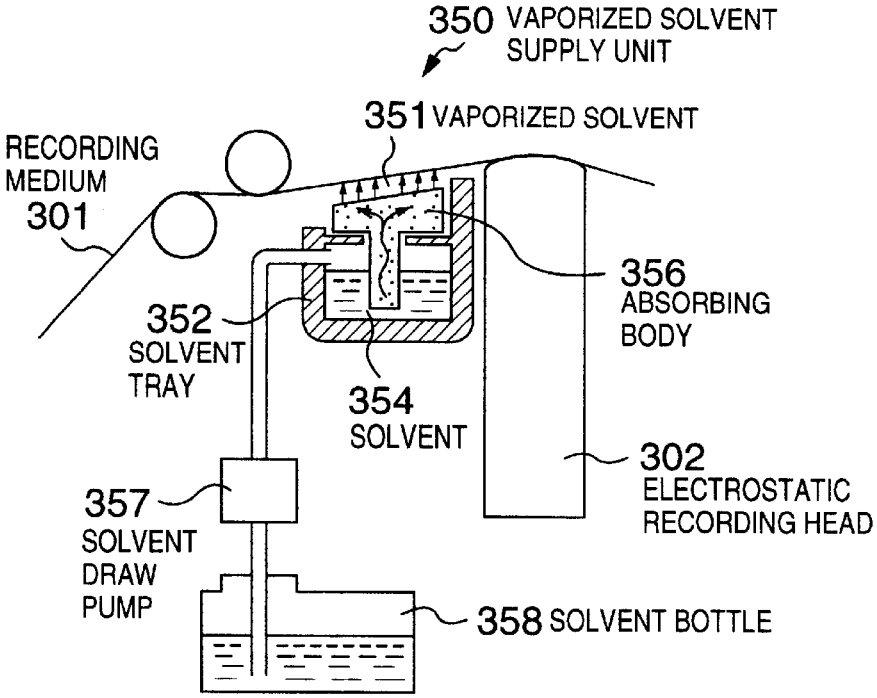
FIG. 7 is a schematic diagram of an electrostatic recording apparatus in accordance with a third embodiment of the first electrostatic recording apparatus of the present invention.

An explanation will next be given of an electrostatic recording apparatus in accordance with a third embodiment of the first electrostatic recording apparatus of the present invention with reference to FIG. 7. The electrostatic recording apparatus is characterized in that a partition is provided between a certain part of an absorbing body 356, which is not soaked in a solvent 354, and a solvent tray 352 (i.e. the opening of the solvent tray 352), and in that the absorbing body 356 is stationary rather than rotatable. Additionally, the solvent 354 within the solvent tray 352 is absorbed upwardly by the absorbing body 251 in a way similar in principle to that of known alcohol lamps with alcohol sucked up therein.

With the electrostatic recording apparatus, a vaporized solvent supply unit 350 includes the solvent tray 352, the absorbing body 356, a solvent draw pump 357 and a solvent bottle 358. The partition is provided at the opening of the solvent tray 352. The absorbing body 356 has its cross-section of "T"-like shape, and is mounted on the partition of the solvent tray 352 in such a manner that the distal end of a projection is soaked in the solvent 354 within the solvent tray 352. To accelerate the vaporization of the solvent 354, the absorbing body 356 is designed so that its certain part opposing the recording surface of a recording medium 301 increases in surface area. Additionally, the absorbing body 354 is made of sponge or other similar suitable materials.

To ensure that the solvent tray 352 constantly stores therein a predefined amount of the solvent 354, a liquid amount sensor (not shown) may be provided for monitoring the amount of the solvent 354 within the solvent tray 352 on a real time basis. When the solvent 354 decreases in amount, the solvent draw pump 357 is driven to supply the solvent 354 from the solvent bottle 358 to the solvent tray 352.

In the electrostatic recording apparatus, since the vaporized solvent supply unit 350 is provided on the upper process step side of the electrostatic recording head 302, it becomes possible by the vaporized solvent 351 to suppress the "drop out" during recording, which in turn makes it possible to obtain a good image.

Figure 8:
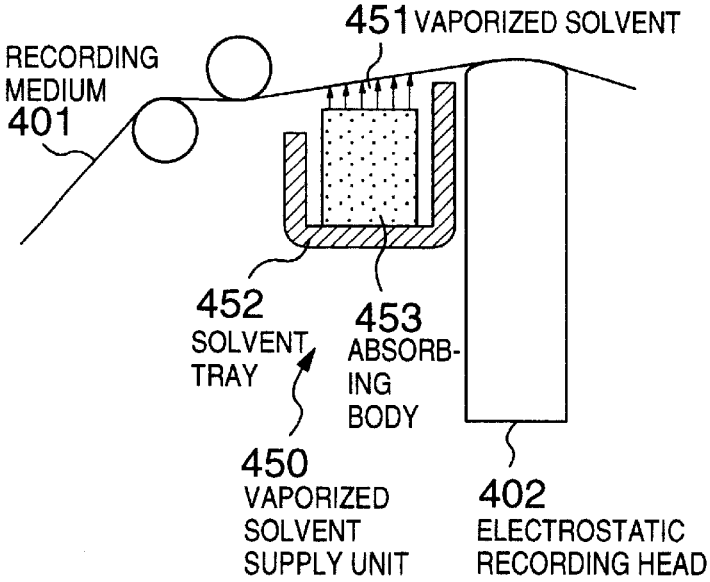
FIG. 8 is a schematic diagram of an electrostatic recording apparatus in accordance with a fourth embodiment of the first electrostatic recording apparatus of the present invention.

Next, an electrostatic recording apparatus in accordance with a fourth embodiment of the first electrostatic recording apparatus of the present invention will be explained with reference to FIG. 8. This electrostatic recording apparatus is aimed at the structural simplification of a vaporized solvent supply unit 450 by consisting the vaporized solvent supply unit 450 of a solvent tray 452 and an absorbing body 453. Accordingly, with the electrostatic recording apparatus, those components including a solvent bottle for additionally supplying or refilling a solvent are not provided therein; thus, it is required for a user to manually refill the solvent tray 452 with such solvent. However, it becomes possible to supply an additional solvent without removing an electrostatic recording head 402 as in the conventional electrostatic recording apparatus, by specifically arranging the apparatus so that the width of the solvent tray 452 and absorbing body 453 are greater than the full width of a recording medium 401 thereby permitting a solvent to drop down into the absorbing body 453 that is elongated outwardly from the opposite edges of the recording medium 401 as shown in FIG. 9.

With the electrostatic recording apparatus, as the vaporized solvent supply unit 450 is provided in the upstream of the electrostatic recording head 402 along the image-print process flow, it becomes possible by a vaporized solvent 451 to suppress the "drop out" during recording, which in turn makes it possible to obtain a good image. In addition, since it is possible to refill the absorbing body 453 with a solvent while allowing the recording medium 401 to be kept loaded into the electrostatic recording apparatus, the resultant workability may be noticeably improved as compared to the conventional electrostatic recording apparatus.

Figure 11:
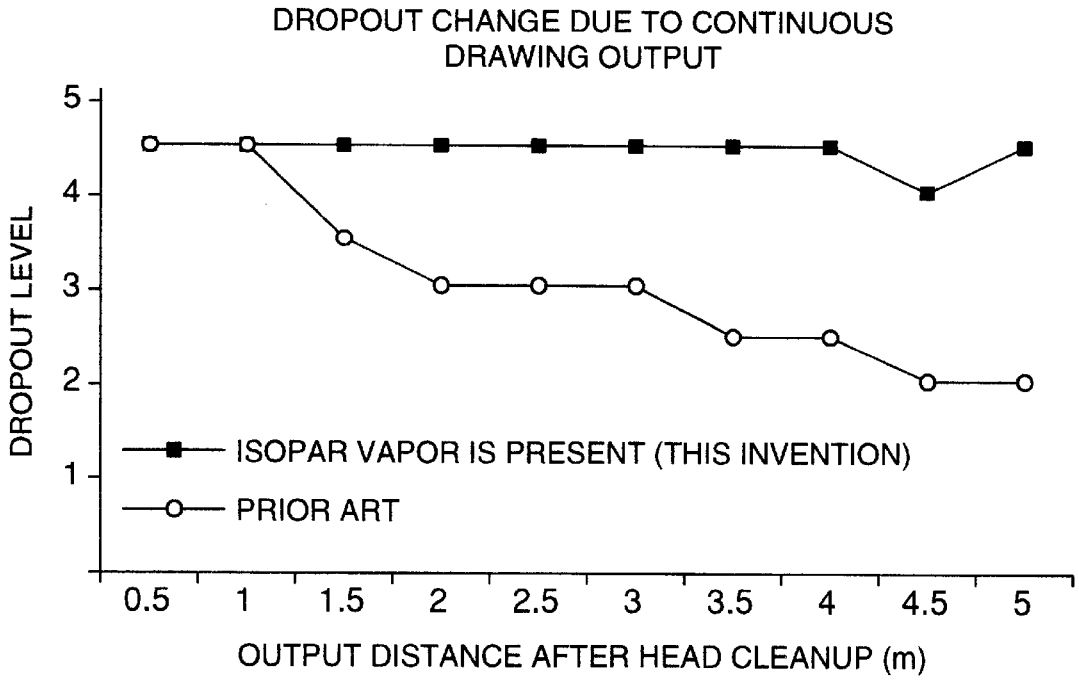
FIG. 11 is a graph indicative of a comparison result in the drop-out generation frequency between the first electrostatic recording apparatus of the present invention and a conventional electrostatic recording apparatus.

An explanation will next be given of an experimental result of comparison in the "drop out" generation frequency between the first electrostatic recording apparatus of the present invention and the conventional electrostatic recording apparatus. FIGS. 10 and 11 show this experimental result, wherein the vertical axis of the graph shown in FIG. 11 indicates some levels of "drop out" in five-step evaluation. Level "5" shows the best state with the "drop out" being absent completely. Conversely, Level "1" is indicative of the state that the "drop out" is extremely increased in number. It should be noted here that the "drop out" levels shown herein are determined by preparing the one with line data pre-recorded on a recording medium and level-divided into Levels "1" to "5" to compare it with those as actually recorded using the first electrostatic recording apparatus of the present invention and conventional electrostatic recording apparatus. Also note that the horizontal or lateral axis of the graph shown in FIG. 11 indicates the distance (length) that is experienced the continuous recording after the completion of the manual cleanup procedure of an electrostatic recording head(s). In this experimentation, the evaluation data of 0.5 mm is recorded progressively on ten (10) sheets of paper to obtain up to 5 meters in length, which is then subject to the comparison. Additionally, the recording conditions used herein are as follows: the paper feed speed is 0.5 inch per second (ips); temperature is 22° C.; humidity is 54%; and resolution is 400 dots per inch (dpi).

Figures 9, 10:
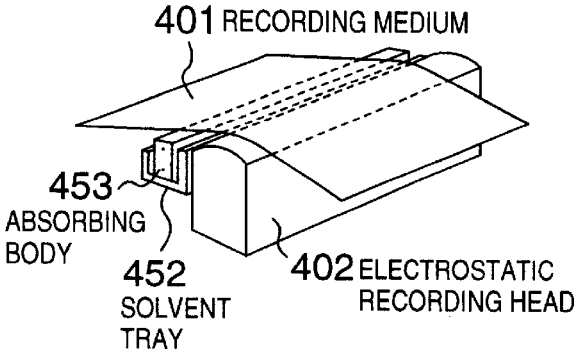
FIG. 9 is a diagram showing a perspective view of the electrostatic recording apparatus shown in FIG. 8.
FIG. 10 is a table indicative of a comparison result in the drop-out generation frequency between the first electrostatic recording apparatus of the present invention and a conventional electrostatic recording apparatus.

As shown in FIGS. 10 and 11, in the first electrostatic recording apparatus of the present invention, the "drop out" level stays substantially constant, whereas the conventional electrostatic recording apparatus suffers from the gradual reduction of the "drop out" level resulting in a decrease in image quality.

The first electrostatic recording apparatus of the present invention should not be limited only to the embodiments discussed above. For example, the solvent supply unit is modifiable so that the solvent tray alone is used to apply a naturally vaporized solvent against the recording surface of the recording medium, or alternatively ultrasonic waves may be used to vaporize the solvent for application to the recording surface of the recording medium. In addition, regarding the color electrostatic recording apparatus, it should not exclusively be limited to the one employing the single path scheme, and may also be applicable to multi-path electrostatic recording apparatus; in this case also, similar effects and advantages are obtainable by providing the vaporized solvent supply unit in the upstream of its associative electrostatic recording head(s) along the route of color image printout processes.

(Second Electrostatic Recording Apparatus)

Figure 12:
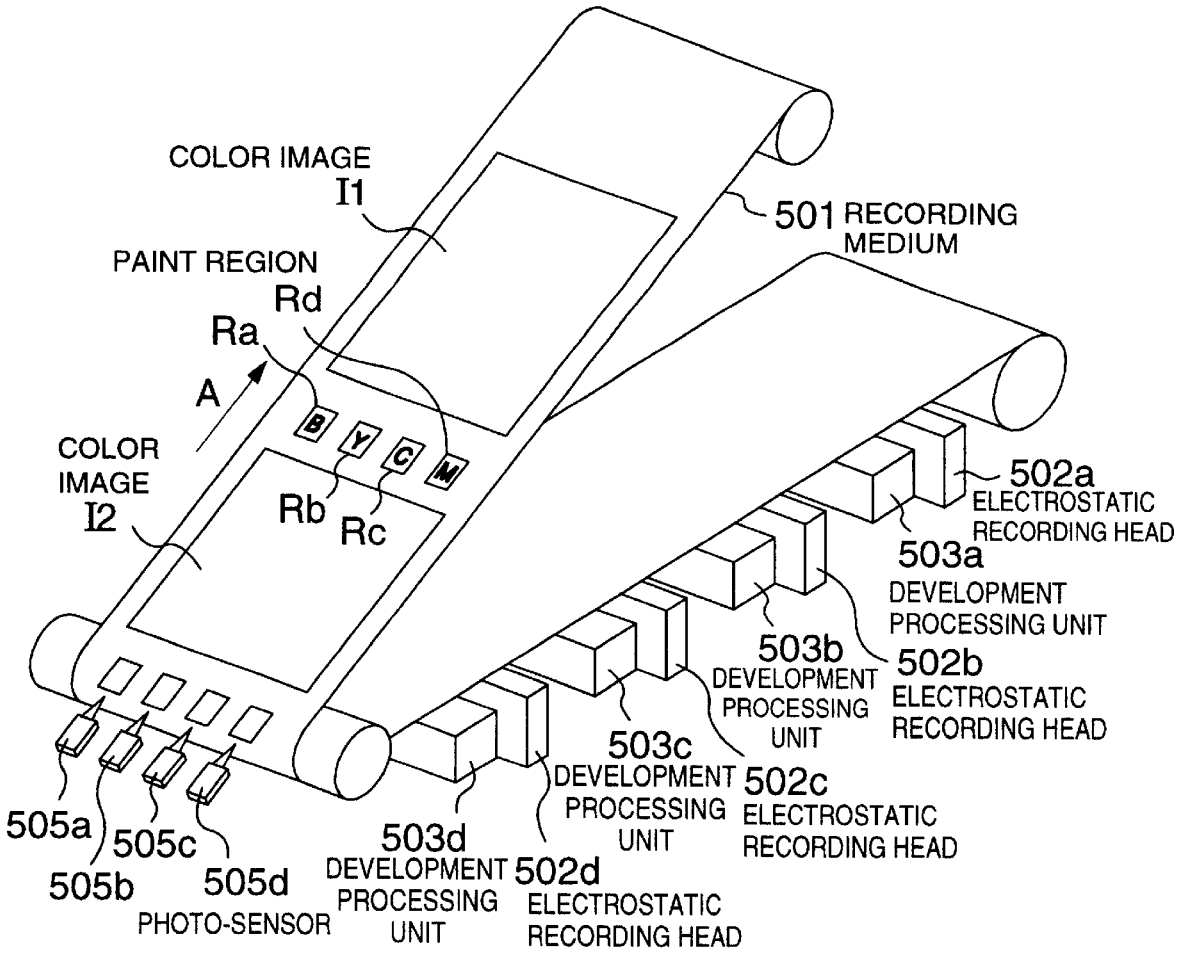
FIG. 12 is a diagram showing a situation in which an image or the like is recorded on a recording medium such as paper by an embodiment of a second electrostatic recording apparatus of the present invention.

As shown in FIG. 12, an electrostatic recording apparatus in accordance with a second electrostatic recording apparatus of the present invention is a single-path electrostatic recording apparatus which includes a recording medium 501 wound into a roll-like shape and transported in a direction indicated by arrow "A" in the drawing; an electrostatic recording head 502*a* and development processing unit 503*a* for black; an electrostatic recording head 502*b* and development processing unit 503*b* for yellow; an electrostatic recording head 502*c* and development processing unit 503*c* for cyan, an electrostatic recording head 502*d* and development processing unit 503*d* for magenta; and a photo-sensor 505*a* for black, photo-sensor 505*b* for yellow, photo-sensor 505*c* for cyan and photo-sensor 505*d* for magenta all of which are disposed along the width of the recording medium 501.

Figure 13:
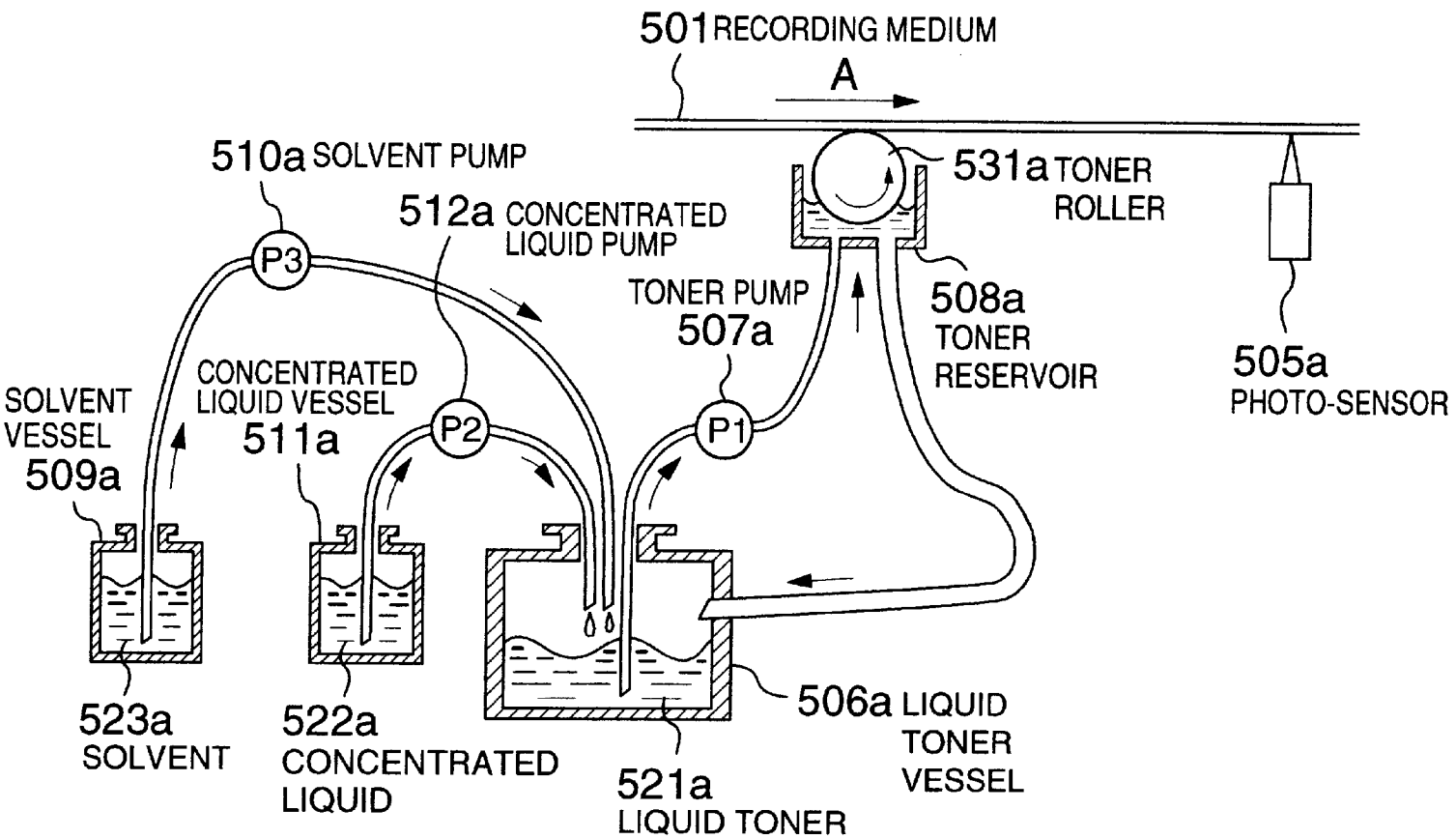
FIG. 13 is a diagram showing a flow of a diluted liquid's mixed toner, solvent and concentrated liquid in the electrostatic recording apparatus shown in FIG. 12.

As shown in FIG. 13, the development processing unit 503*a* for black includes a toner roller 531*a* for coating the recording medium 501 with a liquid toner 521*a* for black; a toner reservoir 508*a* in which a part of the toner roller 531*a* is soaked in the liquid toner 521*a* for black; a liquid toner vessel 506*a* storing therein the liquid toner 521*a* for black; a concentrated liquid vessel 511*a* for storing therein a concentrated liquid 522*a* for black; a solvent vessel 509*a* containing therein a solvent 523*a* for black; a toner pump 507*a* for supplying the liquid toner 521*a* within the liquid toner vessel 506*a* to the toner reservoir 508*a*; a concentrated liquid pump 512*a* for supplying the concentrated liquid 522*a* within the concentrated liquid vessel 511*a* to the liquid toner vessel 506*a*; and a solvent pump 510*a* for supplying the solvent 523*a* within the solvent vessel 509*a* to the liquid toner vessel 506*a*. Note that a part of the liquid toner 521*a* supplied to the toner reservoir 508*a* is collected for the reuse and returned to the liquid toner vessel 506*a*.

In the color electrostatic recording apparatus, the recording medium 501 is transported in the direction shown by arrow "A" in the drawing. During the transportation, the recording medium 501 passes through the four sets of electrostatic recorder units (the electrostatic recording head 502*a* and development processing unit 503*a* for black; the electrostatic recording head 502*b* and development processing unit 503*b* for yellow; the electrostatic recording head 502*c* and development processing unit 503*c* for cyan; and the electrostatic recording head 502*d* and development processing unit 503*d* for magenta), whereby a color image I1 is formed on the recording medium 501. Thereafter, while the recording medium 501 is being transported in the direction of arrow "A", the recording medium 501 passes through the four sets of electrostatic recorder units, whereby four different mono-colors of black, yellow, cyan and magenta are recorded in a black paint region Ra, yellow paint region Rb, cyan paint region Rc and magenta paint region Rd, respectively, which regions are provided and aligned along the width of the recording medium 501. The mono-color density may be set at 100% density, although this will not always be required as far as the density is kept constant. Thereafter, the recording medium 501 is further transported in the direction of arrow "A" to pass through four sets of electrostatic recorder units, whereby a color image I2 is formed on the recording medium 501.

The photo-sensor 505*a* for black, the photo-sensor 505*b* for yellow, the photo-sensor 505*c* for cyan and the photo-sensor 505*d* for magenta are operable so that each of them emits light toward its corresponding one of the paint regions Ra–Rd and then detects the reflection light therefrom, thereby collecting image density data for use in performing the adjustment of each color's liquid toner density.

Next, there will be explained a method for adjusting the density of the liquid toner for black with reference to FIG. 14. Note here that the same goes with the density adjustment methods for the remaining colors. The vertical axis of a graph shown in FIG. 14 indicates the output voltage of the photo-sensor 505*a* for black, whereas its lateral axis is indicative of time elapsed. Note that the output voltage of the photo-sensor 505*a* is such that the less the intensity of the reflection light, the greater the output voltage, and the greater the former, the less the latter. Value H3 plotted in the vertical axis corresponds to an upper limit value; value H2 corresponds to a density level for use in electrically driving the solvent pump 510*a* to turn on; and value H1 corresponds to a density for use in turning off the concentrated liquid pump 512*a*. Value AV corresponds to an appropriate or averaged density. Value L1 corresponds to a density level for turning on the concentrated liquid pump 512*a*; value L2 corresponds to a density level for increasing the flow rate of the concentrated liquid 522*a* being supplied from the concentrated liquid pump 512*a* to the liquid toner vessel 506*a*; and value L3 corresponds to a lower limit value.

While the output voltage of the photo-sensor 505*a* exhibits value AV in the initial state (at time $t_0$), it decreases as the recording process on the recording medium 501 proceeds. When at time $t_1$ the output voltage of the photo-sensor 505*a* goes below value L1, the concentrated liquid pump 512*a* is turned on to supply the concentrated liquid 522*a*. Thereafter, when the output voltage of the photo-sensor 505*a* goes beyond value H1 at time $t_2$ due to the supplement of the concentrated liquid 522*a*, the concentrated liquid pump 512*a* is turned off to thereby interrupt the supplement of the concentrated liquid 522*a*.

Thereafter, when the recording process on the recording medium 501 further proceeds and the output voltage of the photo-sensor 505*a* again becomes less than value L1 at time $t_3$, the concentrated liquid pump 512*a* is turned on to supply the concentrated liquid 522*a*. However, it will possibly happen that even upon the supplement of the concentrated liquid 522*a*, the output voltage of the photo-sensor 505*a* behaves to further decrease so that the output voltage of the photo-sensor 505*a* becomes less than value L2 at time $t_4$. If this is the case, the flow rate of the concentrated liquid 522*a* is increased to be fed from the concentrated liquid pump 512*a* to the liquid toner vessel 506*a* in order to recover the density of the liquid toner 521*a*. This would result in the recovery of the density of the liquid toner 521*a*. When the output voltage of the photo-sensor 505*a* becomes greater than value L2 at time $t_5$, the flow rate of the concentrated liquid 522*a* fed from the concentrated pump 512*a* to the liquid toner vessel 506*a* is returned at a constant level. It is noted here that in the alternative of the scheme for employing value L2 alone to determine whether the flow rate of the concentrated liquid 522*a* is to be increased or not, a differential may be provided to the value for determination to thereby eliminate what is called the "hunting". Thereafter, when at time $t_6$ the output voltage of the photo-sensor 505*a* exceeds value H1 due to the supplement of the concentrated liquid 522*a*, the concentrated liquid pump 512*a* is turned off to interrupt the supplement of the concentrated liquid 522*a*.

Thereafter, when the recording process on the recording medium 501 further proceeds and the output voltage of the photo-sensor 505*a* is again below value L1 at time $t_7$, the concentrated liquid pump 512*a* is turned on to supply the concentrated liquid 522*a*. When the supplement of the concentrated liquid 522*a* may result in the output voltage of the photo-sensor 505*a* going beyond value H1 at time $t_8$, the concentrated liquid pump 512*a* is turned off. However, when the liquid toner 521*a* can further increase in density resulting in the output voltage of the photo-sensor 505*a* being greater than value H2, the solvent pump 510*a* is turned on to decrease the density of the liquid toner 521*a*. Whereby, when at time $t_{10}$ the output voltage of the photo-sensor 505*a* is below value H2, the solvent pump 510*a* is turned off. Note that in place of the scheme for using value L2 alone for the determination of turn-on/off of the solvent pump 510*a*, a differential may be provided to this value for determination thereby performing the so-called "hunting" elimination.

Thereafter, when the recording process on the recording medium 501 further proceeds and the output voltage of the photo-sensor 505*a* again goes below value L1 at time $t_{11}$, the concentrated liquid pump 512*a* is turned on to supply the concentrated liquid 522*a*. However, when the output voltage of the photo-sensor 505*a* further decreases in spite of the supplement of the concentrated liquid 522*a* and the output voltage of the photo-sensor 505*a* is less than value L2 at time $t_{12}$, the flow rate of the concentrated liquid 522*a* supplied from the concentrated liquid pump 512*a* to the liquid toner vessel 506*a* is increased in order to recover the density of the liquid toner 521*a*. However, even after such flow rate increase, the output voltage of the photo-sensor 505*a* can continue further decreasing in amplitude. When the output voltage of the photo-sensor 505*a* becomes less than the lower limit value L3 at time $t_{13}$ as shown by curve "X" in FIG. 14, activate a buzzer and/or visually indicate a message or the like in order to inform workers such as operators, of the occurrence of the abnormal situation. Additionally, the output voltage of the photo-sensor 505*a* will goes below the lower limit value L3 in cases where, for example, the recording medium 501 is paper, and waste paper or an increased amount of dielectric components used as the coat component on the surface of paper are mixed into the liquid toner 512*a* resulting in unavailability of the toner's inherent functionality. In the case the output voltage of the photo-sensor 505*a* is less than the lower limit value L3, the liquid toner vessel 506*a* per se will be replaced with a new one.

Figure 14:
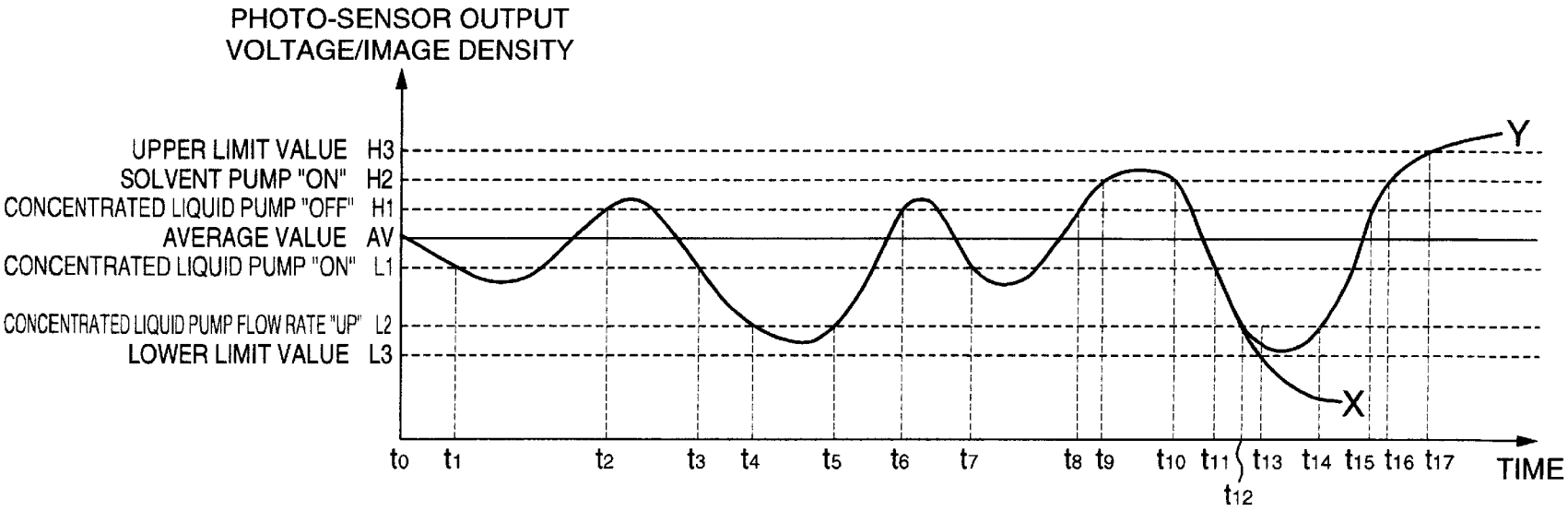
FIG. 14 is a graph for explanation of an adjustment method in the electrostatic recording apparatus of FIG. 12.

On the other hand, when the density of the liquid toner 521*a* recovers as shown by curve "Y" in FIG. 14 due to the increase of the flow rate of the concentrated liquid 522*a* and the output voltage of the photo-sensor 505*a* exceeds value L2 at time $t_{14}$, the flow rate of the concentrated liquid 522*a* fed from the concentrated liquid pump 512*a* to the liquid toner vessel 506*a* is returned to its original constant amount. Thereafter, when the output voltage of the photo-sensor 505*a* goes beyond value H1 at time $t_{15}$ due to the supplement of the concentrated liquid 522*a*, the concentrated liquid pump 512*a* is turned off to stop the supplement of the concentrated liquid 522*a*. However, when the liquid toner 521*a* further increases in density and the output voltage of the photo-sensor 505*a* becomes greater than value H2 at time $t_{16}$, the solvent pump 510*a* is turned on to reduce the density of the liquid toner 521*a*. However, when the liquid toner 521*a* can further increase in density even after this processing and the output voltage of the photo-sensor 505*a* exceeds the upper limit value H3 at time $t_{17}$, activate a buzzer and/or visually indicate a message or the like in order to inform workers or operators of the occurrence of the abnormal situation. Additionally, the output voltage of the photo-sensor 505*a* will exceed the upper limit value H3 in cases where those solid components of liquid toner of dark colors are mixed into a liquid toner of bright color, by way of example. In the case the output voltage of the photo-sensor 505*a* stays above the upper limit value H3, the liquid toner vessel 506*a* will be replaced by a new one.

Figure 15:
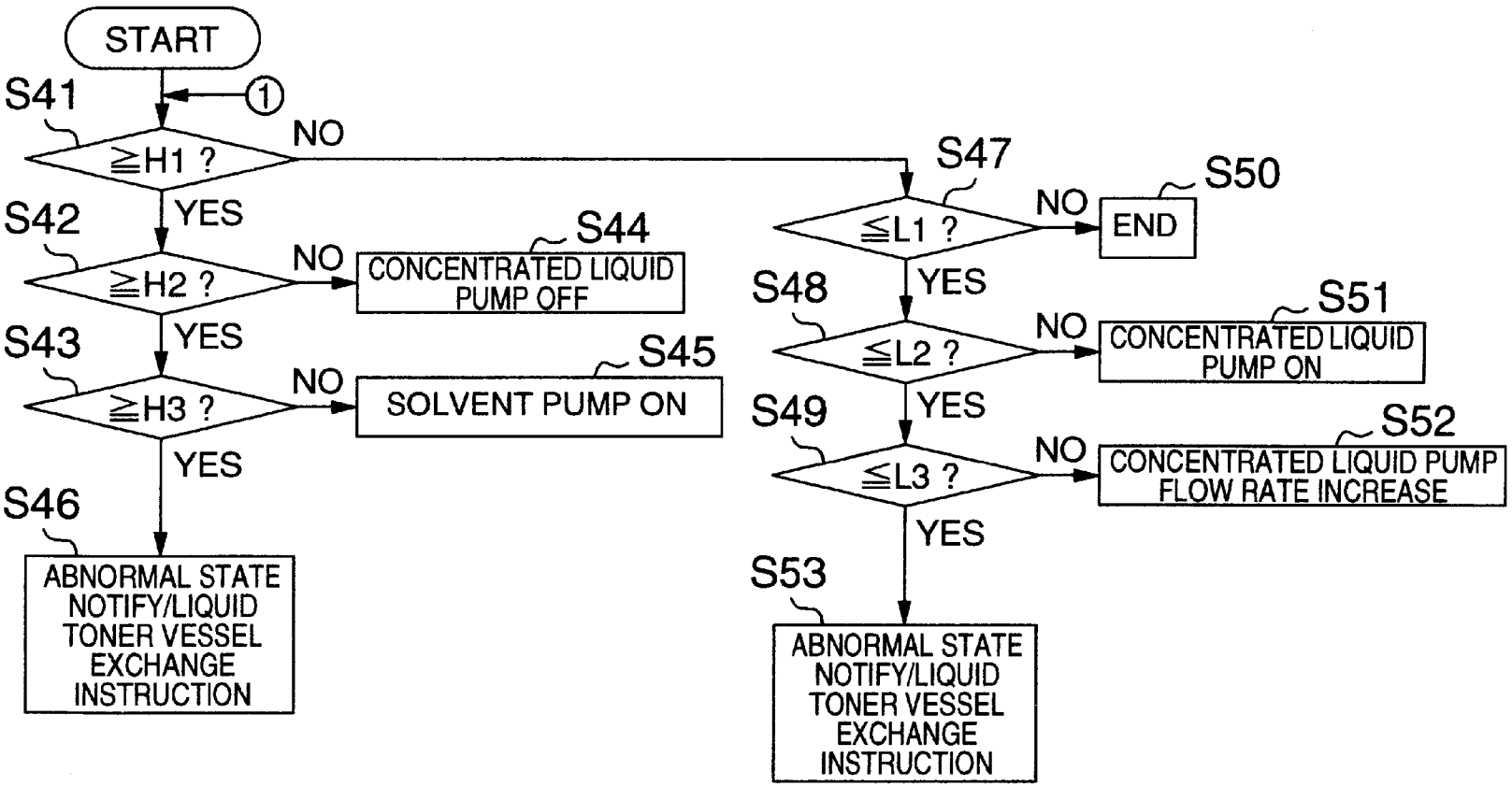
FIG. 15 is a flow chart showing a control method for performing adjustment in the electrostatic recording apparatus shown in FIG. 12.

The operation above is performed by use of either a control device (not shown) provided in the electrostatic recording apparatus or a computer (neither shown) connected to the electrostatic recording apparatus. An operation of such control device or computer will be explained with reference to a flow chart shown in FIG. 15, which assumes the density adjustment is done for the liquid toner for black by way of example. Note that other colors are similar thereto in the liquid toner density adjustment method.

The output voltage of the photo-sensor 505*a* is monitored to determine whether the output voltage of the photo-sensor 505*a* exceeds value H1 (at step S41). If the judgment is "NO" at step S41 (that is, when the output voltage of the photo-sensor 505*a* is smaller than value H1), it is determined whether the output voltage of the photo-sensor 505*a* is below value L1 (at step S47). If "NO" at step S47 (i.e. when the output voltage of the photo-sensor 505*a* is larger than value L1), the control is terminated (step S50). The density of the liquid toner 521*a* in this case is almost at the average value.

If "YES" at step S41 (namely, when the output voltage of the photo-sensor 505*a* is greater than or equal to value H1), it is determined whether the output voltage of the photo-sensor 505*a* goes beyond value H2 (at step S42). If "NO" at step S42 (that is, when the output voltage of the photo-sensor 505*a* is less than value H2), the concentrated liquid pump 512*a* is turned off (at step S44). The density of the liquid toner 521*a* in this case corresponds to an intermediate value between value H1 and value H2.

If "YES" at step S42 (that is, when the output voltage of the photo-sensor 505*a* is greater than or equal to value H2), it is determined whether the output voltage of the photo-sensor 505*a* exceeds value H3 (at step S43). If "NO" at step S43 (that is, when the output voltage of the photo-sensor 505*a* is less than value H3), the solvent pump 510*a* is turned on (step S45). This results in a decrease in the density of the liquid toner 521*a*. On the contrary, if "YES" at step S43 (that is, when the output voltage of the photo-sensor 505*a* is more than or equal to value H3), the abnormal state notification procedure or alternatively the replacement of the liquid toner vessel 506*a* by a new one is performed (step S46).

If "YES" at step S47 (that is, when the output voltage of the photo-sensor 505*a* is less than or equal to value L1), it is determined whether the output voltage of the photo-sensor 505*a* is below value L2 (step S48). If "NO" at step S48 (that is, when the output voltage of the photo-sensor 505*a* is greater than value L1), the concentrated liquid pump 512*a* is turned on (step S51). This results in an increase in the density of the liquid toner 521*a*. If otherwise "YES" at step S48 (that is, when the output voltage of the photo-sensor 505*a* is less than value L2), it is determined whether the output voltage of the photo-sensor 505*a* goes below value L3 (step S49). If "NO" at step S49 (that is, when the output voltage of the photo-sensor 505*a* is larger than value L3), an instruction to increase the flow rate of the concentrated liquid pump is issued (step S52). This results in a further increase in the density of the liquid toner 521*a*. On the contrary, if "YES" at step S49 (that is, when the output voltage of the photo-sensor 505*a* is less than value L3), the abnormal state notifying procedure or alternatively the replacement of the liquid toner vessel 506*a* by a new one is performed (step S53).

With the control procedure noted above, the supplement of the concentrated liquid and solvent is well controlled in accordance with the detected image density while permitting issuance of an instruction to replace the liquid toner vessel 506*a* in cases where such detected image density is out of a predefined range; thus, it becomes possible to constantly retain the image density.

Figure 16:
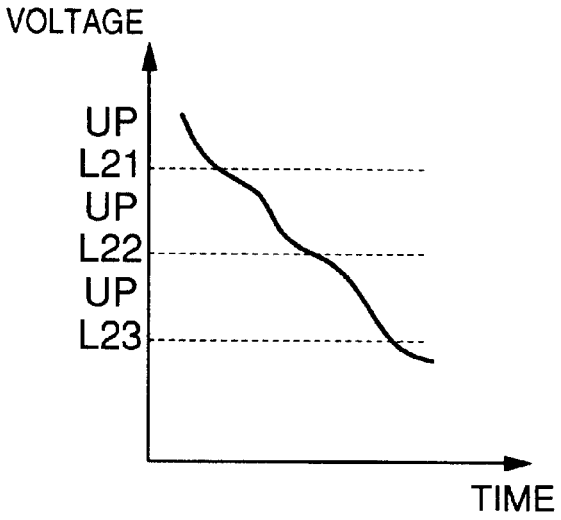
FIG. 16 is a graph for explanation of another flow rate control of concentrated liquid pump in the electrostatic recording apparatus shown in FIG. 12.
Figure 17:
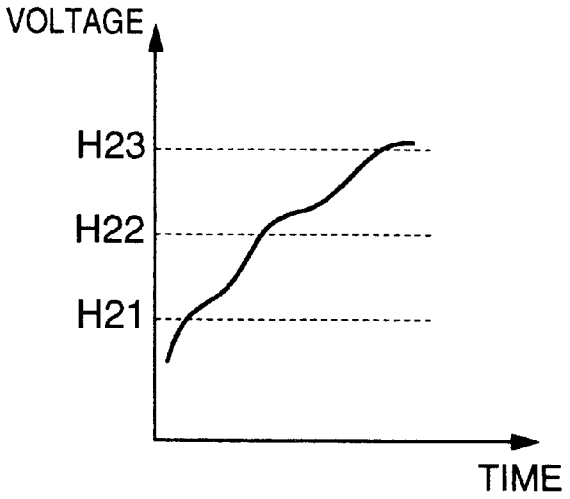
FIG. 17 is a graph for explanation of another flow rate control of solvent pump in the electrostatic recording apparatus shown in FIG. 12.

It is noted that while the scheme for the control of the concentrated liquid pump 512*a* and solvent pump 510*a* may be arranged in a single stage or two stages in the way stated supra, multiple stages may alternatively be employable as shown in FIGS. 16 and 17.

FIG. 16 is a graph for explanation of the flow rate control of the concentrated liquid pump 512*a*, which shows one exemplary case where three levels are provided in accordance with the output voltage of the photo-sensor 505*a* (i.e. image density). More specifically, with this flow rate control, the flow rate of the concentrated liquid pump 512*a* is gradually increased every time when the output voltage of the photo-sensor 505*a* goes below any one of the three levels L21, L22, L23. FIG. 17 is a graph for explanation of the flow rate control of the solvent pump 510*a*, which shows an exemplary case where three levels are provided in accordance with the output voltage of the photo-sensor 505*a* (i.e. image density). More specifically, with this flow rate control, the flow rate of the solvent pump 510*a* is gradually increased whenever the output voltage of the photo-sensor 505*a* goes beyond one of the three levels H21, H22, H23. With such flow rate control performed, it is possible to supply the appropriate amounts of the concentrated liquid 522*a* and solvent 523*a* and thus shortening a time taken to render the image density constant.

Additionally, while the control of the concentrated liquid pump 512*a* and solvent pump 510*a* is in multi-step scheme stated above, the proportional control schemes may alternatively be used to control the flow rate of the concentrated liquid pump 512*a* in a way independent of that of the solvent pump 510*a*.

Figure 18:
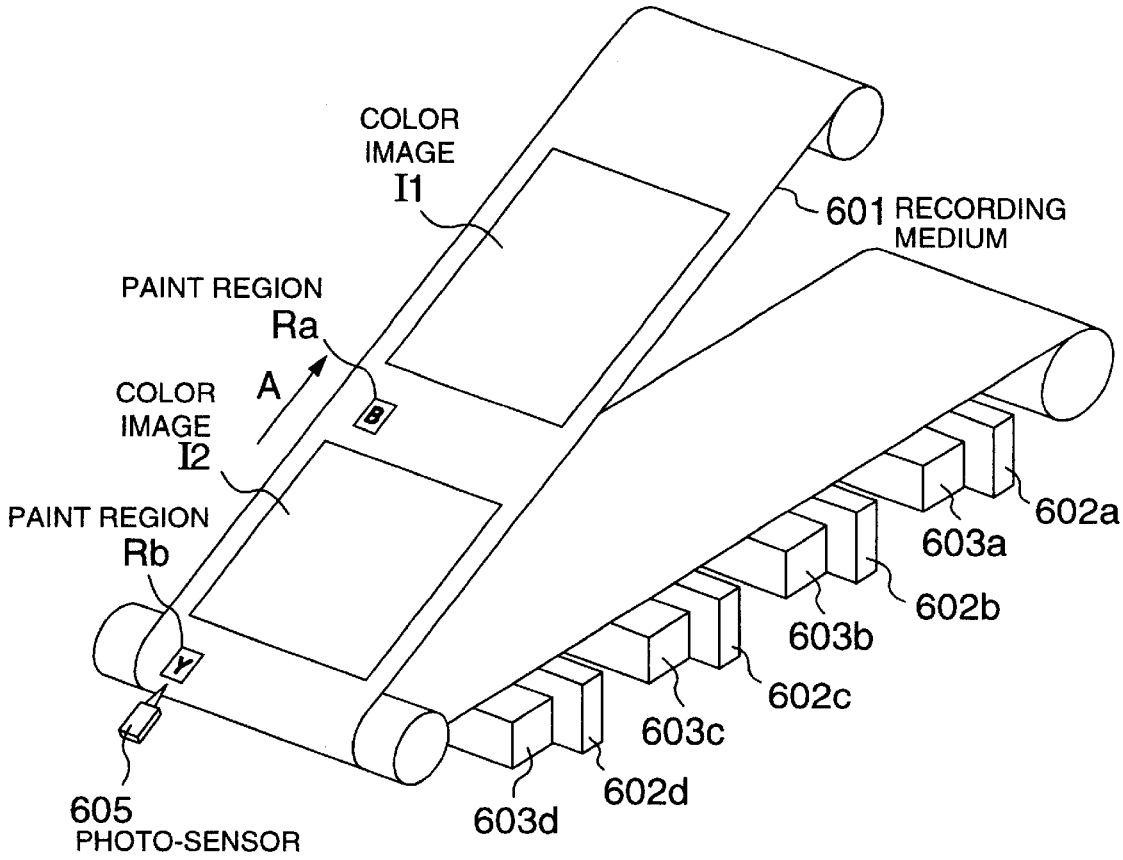
FIG. 18 is a diagram showing a situation in which an image or the like is recorded on a recording medium such as paper by another embodiment of the second electrostatic recording apparatus of the present invention.

Turning now to FIG. 18, there is shown an electrostatic recording apparatus in accordance with another embodiment of the second electrostatic recording apparatus of the present invention, which is different over the color electrostatic recording apparatus shown in FIG. 12 in that the four photo-sensors 505*a*–505*d* laid out along the width of the recording medium 501 is replaced by a single photo-sensor 605, and in that the paint regions Ra–Rd for respective colors are recorded one by one in marginal spaces between adjacent images as recorded on the recording medium 601.

More specifically, in the color electrostatic recording apparatus of this embodiment, a black paint region Ra is recorded between a color image I1 and a color image I2; a yellow paint region Rb is recorded between the color image I2 and a color image I3 (not shown); a cyan paint region Rc is between the color image I3 and a color image I4 (not shown); and a magenta paint region Rd is between the color image I4 and a color image I5 (not shown). Accordingly, the photo-sensor 605 is operable to collect the image density data in units of the paint regions Ra–Rd.

In the color electrostatic recording apparatus of this embodiment also, it is possible by performing the density adjustment method stated above to constantly maintain the image quality of the printed images.

Although in the above explanation the paint regions Ra–Rd for respective colors are recorded between the color images, these may alternatively be recorded at those portions of the recording medium which are on the opposite peripheral sides of the color image and are recorded with no images. Additionally, the frequency of recording such paint regions Ra–Rd for respective colors may be determined in a way corresponding to the image data to be printed or at certain intervals each corresponding to a pre-specified number of the images to be printed.

(Third Electrostatic Recording Apparatus)

Figure 19:
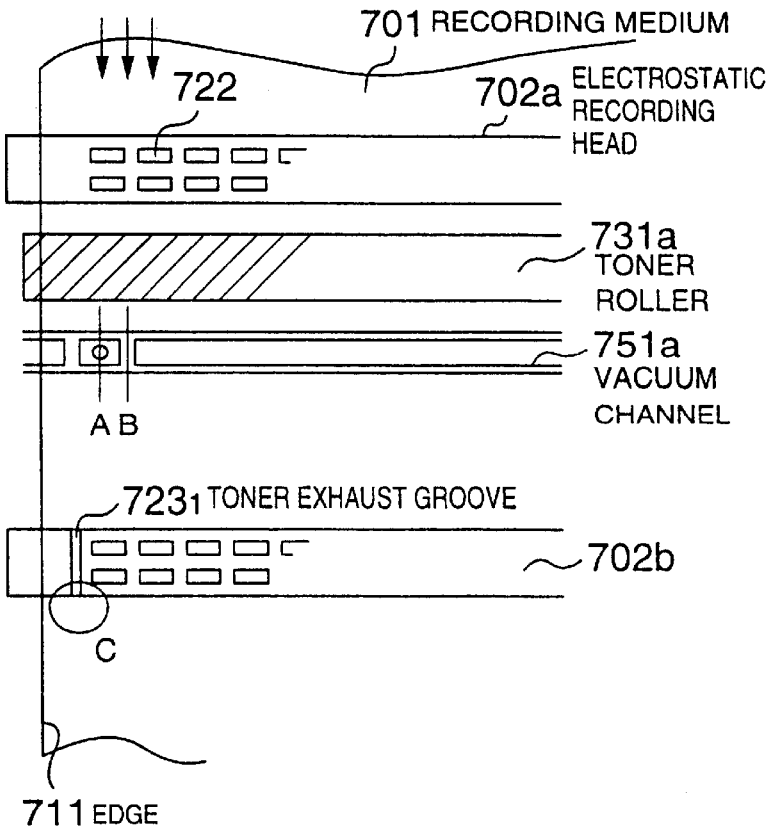
FIG. 19 is a diagram showing an electrostatic record head and development processing unit in accordance with an embodiment of a third electrostatic recording apparatus of the present invention.
Figure 19A:
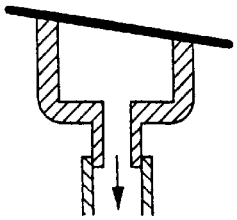
Figure 19B:
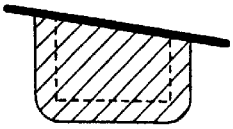
Figure 19C:
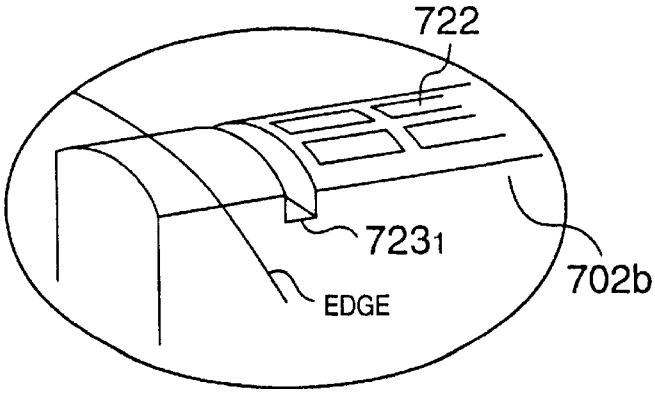

An electrostatic recording apparatus in accordance with one embodiment of a third electrostatic recording apparatus of the present invention is a color electrostatic recording apparatus of the single path scheme, and includes an electrostatic recording head 702*a* for black, a toner roller 731*a* for black, and a vacuum channel 751*a* for black as shown in FIG. 19. A recording medium 701, which is wound into a roll-like shape and transported in a direction shown by arrow in the drawing, is narrower in width than the electrostatic recording head 702*a* for black, and also is constantly brought into slidable contact with the electrostatic recording head 702*a* to ensure that no dead fold lines are newly created during the transportation.

Image information corresponding to black components of an input image is input to the electrostatic recording head 702*a* for black causing discharge to generate between the nibs (not shown) of the electrostatic recording head 702*a* for black and the auxiliary electrodes 722 to thereby form on the recording surface of the recording medium 701 an electrostatic latent image that corresponds to the image information. Thereafter, the recording medium 701 is transported to the toner roller 731*a* for black to coat a liquid toner for black on the recording medium 701 along the full width thereof. Whereby, the toner particles in the liquid toner are attracted by the electrostatic force toward the electrostatic latent image and then adhered to the surface of the recording medium 701 so that the electrostatic latent image is developed.

Figure 20:
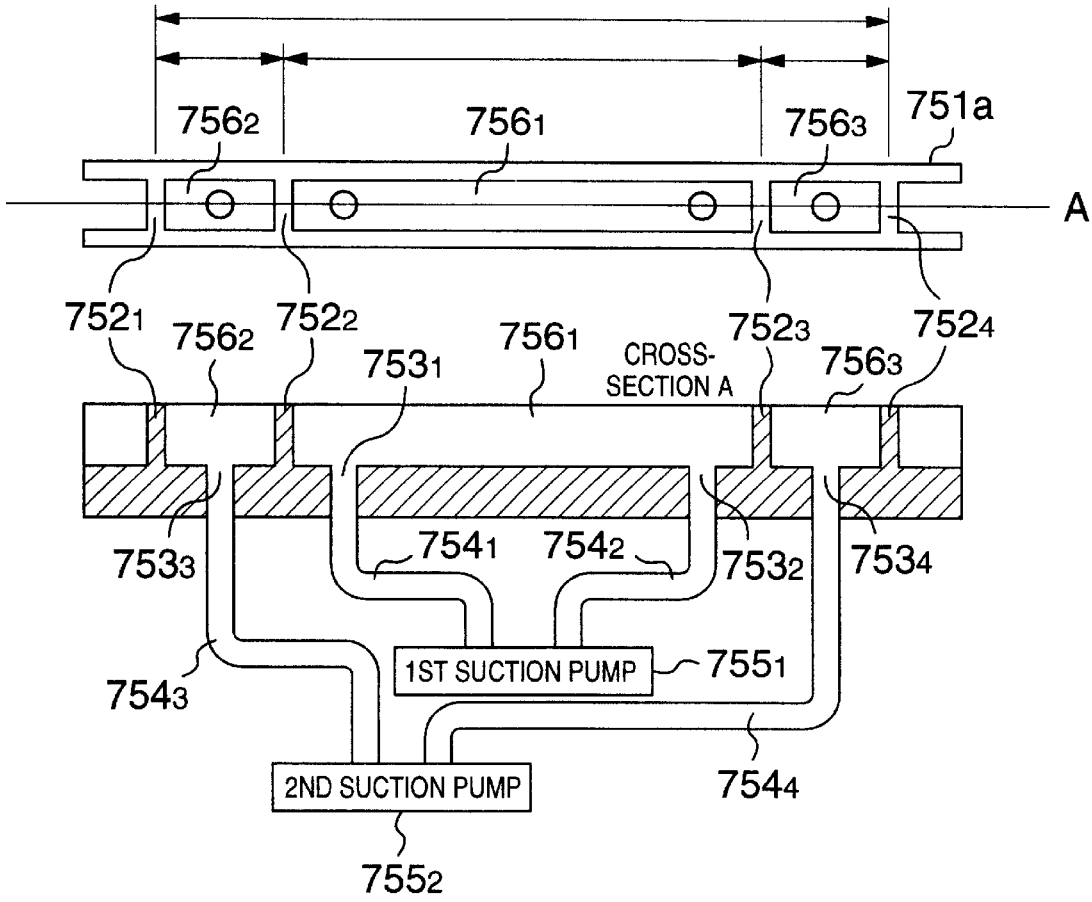
FIG. 20 is a diagram showing a vacuum channel of a toner aspiration unit of the electrostatic recording apparatus shown in FIG. 19.

After having completed such development processing, the recording medium 701 is transported to the vacuum channel 751*a* for black at which any extra liquid toner residing on the surface of the recording medium 701 is sucked and removed away. As shown in FIG. 20, the vacuum channel 751*a* for black includes three separate suction chambers $\mathbf{756}_1$ to $\mathbf{756}_3$. These suction chambers $\mathbf{756}_1$ to $\mathbf{756}_3$ are arranged by forming in a rectangular housing those grooves that are partitioned by four partitions $\mathbf{752}_1$ to $\mathbf{752}_4$.

The centrally located suction chamber $\mathbf{756}_1$ of the vacuum channel 751*a* has its width in the longitudinal direction that is slightly greater than the finally required width of an image to be recorded on the recording medium 701. The central suction chamber $\mathbf{756}_1$ is coupled to a first pump $\mathbf{755}_1$ via two openings $\mathbf{753}_1$, $\mathbf{753}_2$ provided in the bottom of the suction chamber $\mathbf{756}_1$ and two suction pipes $\mathbf{754}_1$, $\mathbf{754}_2$. Consequently, by letting the central suction chamber $\mathbf{756}_1$ of the vacuum channel 751*a* be at a negative pressure by using the first pump $\mathbf{755}_1$, all of extra liquid toner residing on the surface of the recording medium 701 will be sucked and removed away.

The remaining two suction chambers $\mathbf{756}_2$, $\mathbf{756}_3$ are provided on the opposite sides of the central suction chamber $\mathbf{756}_1$, respectively. The suction chamber $\mathbf{756}_1$ and the suction chamber $\mathbf{756}_2$ are partitioned by a partition $\mathbf{752}_2$ whereas the suction chamber $\mathbf{756}_1$ and the suction chamber $\mathbf{756}_3$ are partitioned by a partition $\mathbf{752}_3$. The suction chamber $\mathbf{756}_2$ is coupled to a second pump $\mathbf{755}_2$ via an opening $\mathbf{753}_3$ provided in the bottom of the suction chamber $\mathbf{756}_2$ and a suction pipe $\mathbf{754}_3$. The suction chamber $\mathbf{756}_3$ is coupled to the second pump $\mathbf{755}_2$ via an opening $\mathbf{753}_4$ provided in the bottom of the suction chamber $\mathbf{756}_3$ and a suction pipe $\mathbf{754}_4$. Thus, letting the suction chambers $\mathbf{756}_2$, $\mathbf{756}_3$ on the opposite sides of the vacuum channel 751*a* be at a negative pressure by the second pump $\mathbf{755}_2$ permits suction and removal of residual liquid toner that resides after recording of a tick mark for position alignment of four-color images for main use in forming a color image. Note that a residual liquid toner on the recording medium 701 will hardly be sucked at a portion outside of the partition $\mathbf{752}_1$ of the suction chamber $\mathbf{756}_2$ opposite to the suction chamber $\mathbf{756}_1$ and at a portion outlying the partition $\mathbf{752}_4$ of the suction chamber $\mathbf{756}_3$ opposite to the suction chamber $\mathbf{756}_1$.

Figure 21:
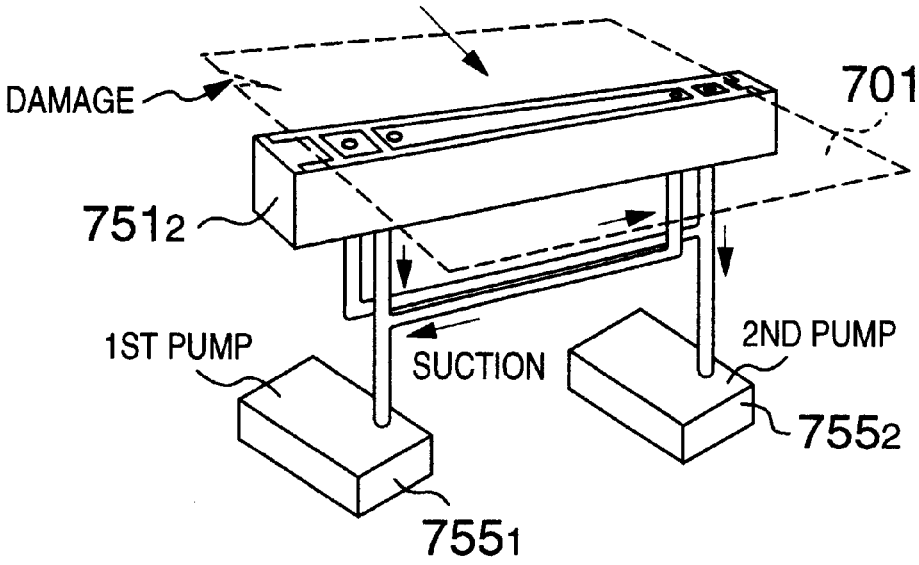
FIG. 21 is a diagram showing a perspective view of the toner aspiration unit shown in FIG. 19.
Figure 22:
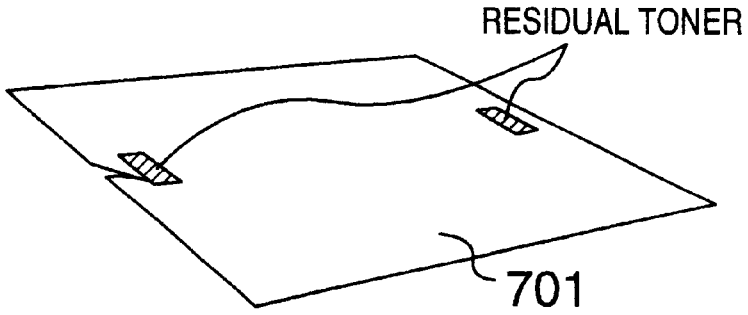
FIG. 22 is a diagram showing residence of a liquid toner in the case of using the toner aspiration unit of FIG. 20.

With the vacuum channel 751*a* thus arranged, in the case the recording medium 701 having damages at its edge portions is transported as shown in FIG. 21, the air attempts to leak from a gap space definable between the recording medium 701 and the vacuum channel 751*a* thereby making it impossible to obtain the intended negative pressure in the suction chambers $\mathbf{756}_2$, $\mathbf{756}_3$ coupled to the second pump $\mathbf{755}_2$. Accordingly, as shown in FIG. 22, residual liquid toner that resides after having recorded a tick mark for position alignment of four-color images for main use in forming a color image fails to be sucked and continues residing thereon. Fortunately, any residual liquid toner on a certain side of the recording medium 701 which remains free from such damages may be sucked and removed away by providing a pump to the individual one of the suction chambers $\mathbf{756}_1$, $\mathbf{756}_3$.

On the other hand, as the central suction chamber $\mathbf{756}_1$ of the vacuum chamber 751*a* is partitioned from the opposite suction chambers $\mathbf{756}_1$, $\mathbf{756}_3$ by the partitions $\mathbf{752}_2$, $\mathbf{752}_3$, the sealed state is held therein. The first pump $\mathbf{755}_1$ is coupled to the central suction chamber $\mathbf{756}_1$ only. Thus, even in this case, the central suction chamber $\mathbf{756}_1$ of the vacuum chamber 751*a* is forced by the first pump $\mathbf{755}_1$ to establish a negative pressure therein. As a result, all portions of extra liquid toner residing in an image formation region of the recording medium 701 are sucked and removed away as shown in FIG. 22.

It is noted that in the case the recording medium 701 is significant in damage to the extent that its damaged part reaches the central suction chamber $\mathbf{756}_1$ of the vacuum chamber 751*a*, it is no longer possible to obtain any negative pressure even in the suction chamber $\mathbf{756}_1$, which would result in inability to remove by suction the extra liquid toner residing in the image formation region of the recording medium 701. However, in this case, such extensive medium damage reaching the image formation region inherently makes it impossible for the image formed on the recording medium 701 to be substantially utilizable.

After the completion of the residual liquid toner suction/removal process at the vacuum channel 751*a* for black, the recording medium 701 is then subject to drying at a driver device (not shown). Thereafter, the recording medium 701 is transported to an electrostatic recording head 702*b* for yellow. At this time, it will possibly happen that the recording medium 701 has a damage at its edge portion, and that residual liquid toner can continue residing at edges of the recording medium 701 whereat the residual liquid toner is left even after the completion of the drying process. If this is the case, in the conventional electrostatic recording apparatus, such residual liquid toner behaves to permeate based on capillary action between the electrostatic recording head for yellow and the recording medium 701 resulting in the contamination of an image formation region of the recording medium 701.

In the electrostatic recording apparatus of this embodiment, toner exhaust grooves $\mathbf{723}_1$, $\mathbf{723}_2$ are provided (only the toner exhaust groove $\mathbf{723}_1$ is shown in the drawing) at the opposite end portions of the electrostatic recording head 702*b* for yellow which are brought into slidable contact with the recording medium 701. More precisely, the toner exhaust grooves $\mathbf{723}_1$, $\mathbf{723}_2$ are disposed outside of a certain location corresponding to the tick mark being formed on the recording medium 701 (that is, further outside of the nib and auxiliary electrode that are at the outermost location). With such an arrangement, even where residual liquid toner left at the edges of the recording medium 701 after the completion of the drying process attempts to permeate by capillarity between the electrostatic recording head 702*b* for yellow and the recording medium 701, it is possible by the toner exhaust grooves $\mathbf{723}_1$, $\mathbf{723}_2$ to prevent such residual liquid toner from arriving at the image formation region of the recording medium 701.

Electrostatic recording heads for cyan and magenta are similar in structure to the electrostatic recording head 702*b* for yellow. Toner rollers and vacuum channels for yellow, cyan and magenta are similar in structure to the toner roller 731*a* and vacuum channel 751*a* for black.

In the electrostatic recording apparatus of this embodiment, when a color image is finally formed on the recording medium 701, its unnecessary part outside of the tick mark portion will be cut away.

Industrial Applicability

According to the first electrostatic recording apparatus of the present invention, since the intended cleaning of an electrostatic recording head of the electrostatic recording apparatus may be readily performed and a good image can be obtained without being affected by a change in humidity of the in-use environments, it is possible to provide an improved electrostatic recording apparatus capable of noticeably lightening users' maintenance workload.

According to the second electrostatic recording apparatus of the present invention and the image density control method of the present invention, it is possible to provide an electrostatic recording apparatus and image density control method capable of accommodating the deterioration of a liquid toner while enabling constant retention of the image quality of an image printed.

In the third electrostatic recording apparatus of the present invention, it is possible to provide an electrostatic recording apparatus capable of removing through suction any liquid toner even in the presence of damages at edges of a recording medium used. It is also possible to provide a color electrostatic recording apparatus capable of preventing an electrostatic recording head of the next color from badly behaving to contaminate the surface of the recording media even when residual liquid toner is left at edges of the recording media after the completion of a drying process.

What is claimed is:

1. An electrostatic recording apparatus comprising:

an electrostatic recording head for forming an electrostatic latent image on a recording medium;

development means for developing said electrostatic latent image using a liquid toner; and vaporized solvent supply means for supplying a vaporized organic solvent to said recording medium, wherein said vaporized solvent supply means is provided on an upper process step side of said electrostatic recording head.

2. An electrostatic recording apparatus according to claim 1, wherein said organic solvent is the same in composition as a solvent for use in diffusing toner particles of said liquid toner.

3. An electrostatic recording apparatus according to claim 2, wherein said vaporized solvent supply means includes solvent tray means for storing said organic solvent, and an absorbable body a part of which is soaked in said organic solvent stored in said solvent tray means.

4. An electrostatic recording apparatus according to claim 1, wherein a plurality of sets each including said vaporized solvent supply means, said electrostatic recording head and said development means are provided for forming a color image on said recording medium.

5. An electrostatic recording apparatus according to claim 4, wherein said vaporized solvent supply means includes solvent tray means for storing said organic solvent, and an absorbable body a part of which is soaked in said organic solvent stored in said solvent tray means.

6. An electrostatic recording apparatus according to any one of claims 1, wherein said vaporized solvent supply means includes solvent tray means for storing said organic solvent, and an absorbable body a part of which is soaked in said organic solvent stored in said solvent tray means.

7. An electrostatic recording apparatus according to claim 6, wherein said absorbable body is sponge.

8. A single-path electrostatic recording apparatus for forming a color image on a recording medium, said apparatus having a serial combination of a necessary number of recording units for use in forming the color image, each said unit including an electrostatic recording head for forming an electrostatic latent image on said recording medium, development means for developing said electrostatic latent image using a liquid toner, and vaporized solvent supply means for supplying a vaporized solvent to said recording medium, wherein said vaporized solvent supply means is provided on an upper process step side of said electrostatic recording head, and comprises solvent tray means for storing said solvent, and an absorbing body a part of which is soaked in said solvent stored in said solvent tray means, and said solvent stored in said solvent tray means is absorbed by said absorbing body, and applies said solvent vaporized from a surface of said absorbing body to a recording surface of said recording medium before said recording medium comes into slidable contact with said electrostatic recording head.

9. An electrostatic recording apparatus according to claim 8, wherein said vaporized solvent supply means further includes solvent supply means for supplying said solvent to said solvent tray means to retain said solvent stored in said solvent tray means at a constant amount.

10. An electrostatic recording apparatus according to claim 8, wherein said absorbing body includes a cylindrical sponge roller.

* * * * *

UNITED STATES PATENT AND TRADEMARK OFFICE

CERTIFICATE OF CORRECTION

PATENT NO. : 6,243,118 B1
DATED : June 5, 2001
INVENTOR(S) : Yoshinori Akichika et al.

It is certified that error appears in the above-identified patent and that said Letters Patent is hereby corrected as shown below:

Title page,
Please change "PCT PUBLICATION DATE: Nov. 6, 1998" to -- PCT PUBLICATION DATE: June 11, 1998 --.

Signed and Sealed this

Thirtieth Day of April, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,243,118 B1
DATED : June 5, 2001
INVENTOR(S) : Yoshinori Akichika et al.

It is certified that error appears in the above-identified patent and that said Letters Patent is hereby corrected as shown below:

Title page,
Item [87], should read as follows:
-- [87] PCT Pub. No.: WO98/25187
PCT Pub. Date: June 11, 1998 --

Signed and Sealed this

Twenty-seventh Day of May, 2003

JAMES E. ROGAN
*Director of the United States Patent and Trademark Office*